US011555623B2

(12) United States Patent
Koop et al.

(10) Patent No.: US 11,555,623 B2
(45) Date of Patent: Jan. 17, 2023

(54) DAMPER TEST SWITCH FAIL-SAFE ACTUATOR

(71) Applicant: AIR DISTRIBUTION TECHNOLOGIES IP, LLC, Milwaukee, WI (US)

(72) Inventors: Edward N. Koop, Olathe, KS (US); Jeffrey Scott Beneke, Peculiar, MO (US); Kent S. Maune, Independence, MO (US); Vikas Ashok Patil, Jaysingpur (IN); Raguraman Gnanavadivel, Kodaikanal (IN)

(73) Assignee: AIR DISTRIBUTION TECHNOLOGIES IP, LLC, Milwaukee, WI (US)

( * ) Notice: Subject to any disclaimer, the term of this patent is extended or adjusted under 35 U.S.C. 154(b) by 359 days.

(21) Appl. No.: 16/803,543

(22) Filed: Feb. 27, 2020

(65) Prior Publication Data

US 2021/0270481 A1 Sep. 2, 2021

(51) Int. Cl.

| | |
|---|---|
| ***F24F 11/33*** | (2018.01) |
| ***F24F 11/34*** | (2018.01) |
| ***F24F 13/10*** | (2006.01) |
| ***F24F 13/075*** | (2006.01) |
| ***F24F 11/49*** | (2018.01) |
| *F24F 140/40* | (2018.01) |
| *F24F 13/14* | (2006.01) |

(52) U.S. Cl.

CPC ..... *F24F 11/34* (2018.01); *F24F 11/49* (2018.01); *F24F 13/075* (2013.01); *F24F 13/10* (2013.01); *F24F 2013/1473* (2013.01); *F24F 2140/40* (2018.01)

(58) Field of Classification Search

CPC ..... A62C 2/24; A62C 2/241
USPC ..... 337/120; 169/57–59
See application file for complete search history.

(56) References Cited

U.S. PATENT DOCUMENTS

| | | | | | |
|---|---|---|---|---|---|
| 2,913,552 | A * | 11/1959 | Roberts | H01H 73/30 | 337/120 |
| 3,913,049 | A * | 10/1975 | Burch | H01H 73/22 | 337/72 |
| 4,841,271 | A * | 6/1989 | Purssell | H01H 35/343 | 200/83 Z |
| 4,846,400 | A * | 7/1989 | Crouse | F23N 3/085 | 126/285 B |
| 5,861,794 | A * | 1/1999 | Pellon | H01H 77/04 | 337/380 |
| 5,929,742 | A * | 7/1999 | Short | H01H 37/5409 | 337/365 |
| 2007/0247272 | A1* | 10/2007 | Fontaine | H01H 77/04 | 337/66 |
| 2018/0311519 | A1* | 11/2018 | Jenks | A62C 2/242 | |

* cited by examiner

*Primary Examiner* — Vivek K Shirsat
*Assistant Examiner* — Ko-Wei Lin
(74) *Attorney, Agent, or Firm* — Fletcher Yoder, P.C.

(57) ABSTRACT

A firestat for providing an output for controlling an opening and closing of a fire/smoke damper. The firestat includes a fire/smoke damper test switch and an actuator configured to depress the fire/smoke damper test switch. The firestat is further configured to release the fire/smoke damper test switch in response to a depressing force applied to the actuator, wherein melting or other damage to the actuator causes a release of the test switch.

26 Claims, 15 Drawing Sheets

Primary Cam positions

Secondary Cam positions

DAMPER TEST SWITCH FAIL-SAFE ACTUATOR

BACKGROUND

Fire/smoke dampers control ingress or egress of fire and/or smoke through the ductwork of a ventilation and/or heating, ventilation, and air conditioning (HVAC) system. Fire and smoke dampers are typically used to maintain the required ratings of fire rated barriers (e.g., walls, partitions, floors) and associated ductwork. Dynamic fire/smoke dampers typically include some type of blocking mechanism (e.g., pivoting blades connected to an electric, pneumatic, actuator) that is capable of opening and closing a passage within a duct. A heat responsive device or triggering device may be used to provide a signal to and/or to control the opening and closing of the blocking mechanism based on a detection of excessive heat, smoke, other pollutants, and/or fire. Generally, fire/smoke fire/smoke dampers and their respective control device (i.e., a heat responsive device or triggering device) are regularly tested and inspected to assure that the system is functioning properly. Thus, a heat responsive device or triggering device may include provisions (e.g., switches or buttons), that allow a user or technician to test the device regularly.

Dynamic or static fire/smoke fire/smoke dampers may be used were it is desirable to maintain control of multiple dampers from a single location. In such a system, if smoke, fire, and/or pollutants are detected either at a particular fire/smoke damper and/or from another source or remote fire/smoke damper, the blocking mechanisms in the system may be selectively closed and locked. When the smoke, fire, and or pollutants are no longer present and/or a smoke signal (i.e., a signal that indicates that smoke, fire, and/or pollutants are present) ceases, the blocking mechanism may be automatically re-opened. Further, an override system may be provided to allow management and/or emergency services to re-open the blocking mechanism. For example, a temperature sensor in the heat responsive device or triggering device may be capable of override as long as a duct temperature near the triggering device is below a set threshold.

SUMMARY

This summary is provided to introduce a selection of concepts in a simplified form that are further described below in the DETAILED DESCRIPTION. This summary is not intended to identify key features of the claimed subject matter, nor is it intended to be used as an aid in determining the scope of the claimed subject matter.

In one aspect of the disclosure, a firestat configured to provide an output for controlling an opening and closing of a fire damper is disclosed. The firestat includes a fire damper test switch and an actuator configured to depress the fire damper test switch, wherein the actuator is further configured to release the fire damper test switch in response to a depressing force applied to the actuator, and wherein a destructive condition to the actuator causes a release of the test switch.

In another aspect of the disclosure, an apparatus for selectively depressing and releasing a fire damper test switch is disclosed. The apparatus further include an actuator configured to depress the fire damper test switch when in a resting state, wherein depressing the actuator causes the actuator to release the fire damper test switch, and wherein failure of the actuator causes a release of the test switch.

These and other features of the of the present disclosure are described in more detail below.

BRIEF DESCRIPTION OF THE DRAWINGS

The features believed to be characteristic of aspects of the disclosure are set forth in the appended claims. In the description that follows, like parts are marked throughout the specification and drawings with the same numerals. The drawing figures are not necessarily drawn to scale and certain figures may be shown in exaggerated or generalized form in the interest of clarity and conciseness. The disclosure itself, however, as well as a preferred mode of use and further advantages thereof, will be best understood by reference to the following detailed description of illustrative aspects of the disclosure when read in conjunction with the accompanying drawings, wherein:

DETAILED DESCRIPTION

Figure 1A:
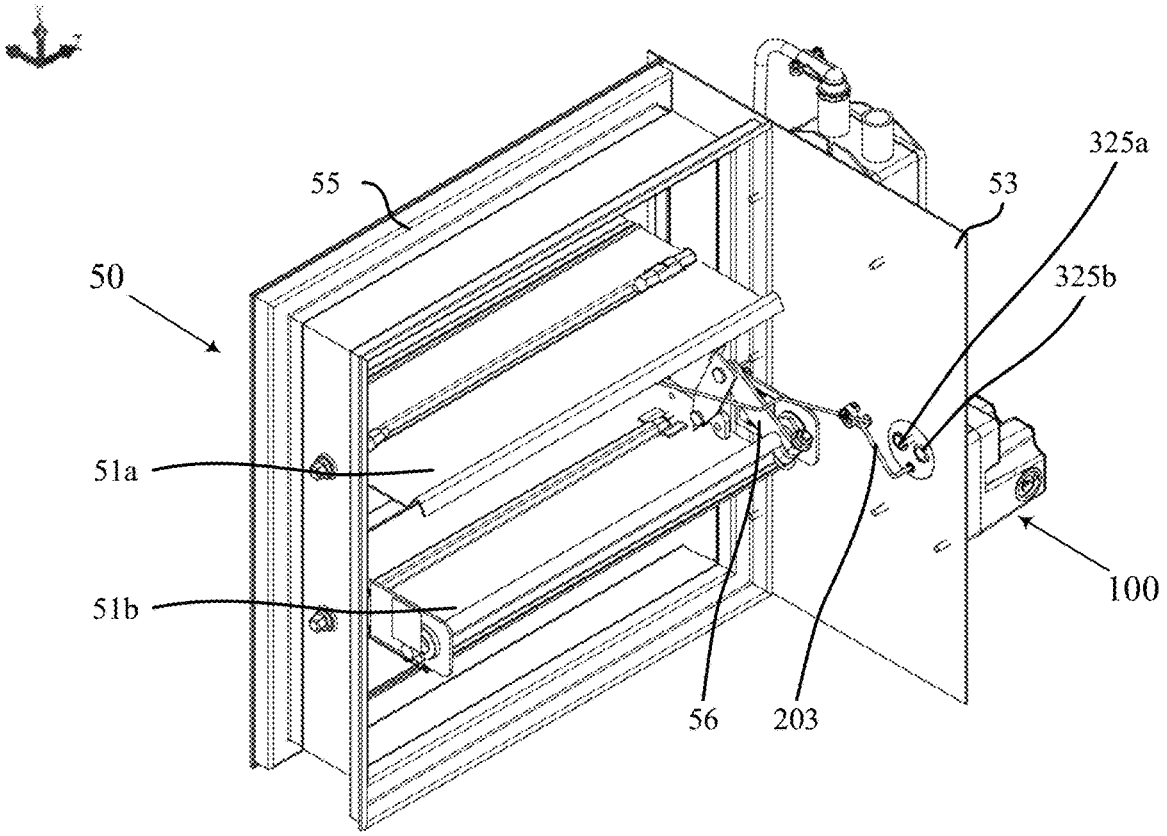
FIG. 1A is a perspective view of one example of a fire/smoke damper system in a first state of operation.

The following includes definitions of selected terms employed herein. The definitions include various examples and/or forms of components that fall within the scope of a term and that may be used for implementation. The examples are not intended to be limiting. Further, it will be obvious to one skilled in the art that the present invention may be practiced without these specific details. In other instances, well-known methods, procedures, and components have not been described in detail so as to not unnecessarily obscure aspects of the present invention.

Throughout the disclosure, the term substantially may be used as a modifier for a geometric relationship between elements or for the shape of an element or component. While the term substantially is not limited to a specific variation and may cover any variation that is understood by one of ordinary skill in the art to be an acceptable variation, some examples are provided as follows. In one example, the term substantially may include a variation of less than 10% of the dimension of the object or component. In another example, the term substantially may include a variation of less than 5% of the object or component. If substantially is used to define the angular relationship of one element to another element, one non-limiting example of the term substantially may include a variation of 5 degrees or less. These examples are not intended to be limiting and may be increased or decreased based on the understanding of acceptable limits to one of ordinary skill in the art.

For purposes of the disclosure, directional terms are expressed generally with relation to a standard frame of reference when the system and apparatus described herein is installed and in an in-use orientation.

The disclosure is related to several components and features usable with a firestat or other heat and/or flame responsive device or triggering device configured to control a heating, ventilation, and air conditioning (HVAC) equipment. The terms firestat, heat responsive device, flame responsive device, and/or triggering device may be used interchangeably throughout the disclosure. One example of the aforementioned device is used to control or otherwise monitor fire/smoke/smoke dampers. Fire/smoke/smoke dampers may control ingress or egress of fire/smoke through the ductwork of a ventilation and/or heating, ventilation, and air conditioning (HVAC) system. fire/smoke dampers may be used to maintain the required ratings of fire rated barriers (e.g., walls, partitions, floors) and associated ductwork. Aspects of the current disclosure are usable with dynamic/static fire/smoke dampers which may include some type of blocking mechanism (e.g., pivoting blades connected to an electric, pneumatic actuator) that is capable of opening and closing a passage within a duct. It is noted that throughout the disclosure the terms, blocking mechanism, blocking device, blade, and/or fire/smoke damper may be used interchangeably and may include any device or structure that may be movable between open and closed positions and/or otherwise is configured control the flow of air or other gasses through ductwork. For example, a firestat may be used to provide a signal to and/or to control the opening and closing of the blocking mechanism based on a detection of excessive heat, smoke, other pollutants, and/or fire. While a specific example of a fire/smoke damper is provided in FIGS. 1A and 1B, the example is merely for context; accordingly, the current disclosure is usable with any known fire/smoke damper, venting, and/or HVAC system.

For context, a general overview of a firestat usable with the current disclosure is provided below. It is noted that while certain features are described, elements of the current disclosure may be usable with alternative firestat and/or control devices and thus are not limited to the specific figures or description provided under this general overview. Further detail of aspects of the current disclosure are provided under each heading below.

Figure 1B:
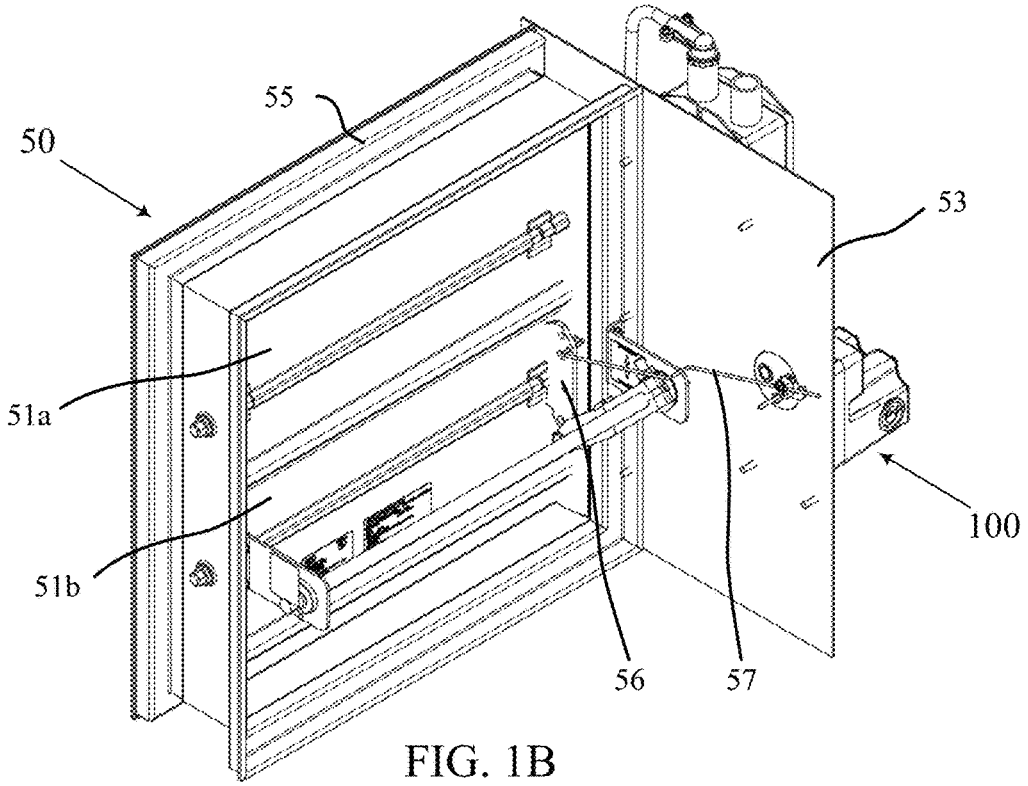
FIG. 1B is a perspective view of the example fire/smoke damper of FIG. 1A in a second state of operation.

FIGS. 1A-1B are perspective views of one example of a smoke and/or fire/smoke damper system usable with the current disclosure. It is noted that throughout the disclosure, the terms fire/smoke damper may be used interchangeably. A fire/smoke damper 50 may include a frame 55 that may be mounted in-line with ductwork of an HVAC or venting system. The fire/smoke damper 50 may include a blocking mechanism, e.g., pivoting blades 51*a* and 51*b* connected to an electric, pneumatic, actuator that is capable of opening and closing a passage within the frame 55 and thus limiting the flow of fluid, e.g., air, within the ductwork of an HVAC or venting system. In the example shown in FIGS. 1A-B, blades 51*a* and 51*b* may be moved between an open position, e.g., as shown in FIG. 1A and a closed position, e.g., as shown in FIG. 1B, or any position in between. While not shown in FIGS. 1A-1B, an electric, pneumatic, and/or hydraulic actuator may provide the opening and/or closing force to blades 51*a* and 51*b* in response to an open and/or close signal provided by an actuator controller (not shown). The actuator controller may provide an open and/or close signal and/or partial open and/or closed signal in response to detected temperature and/or blade position feedback signal provided by a heat responsive device or triggering device. The heat responsive device or triggering device 100 (e.g., firestat) may be mounted to side 53 of a damper sleeve, for example. FIGS. 2A-B, 3, and 4 show examples of a firestat usable with the current disclosure. The firestat device may include outer casings 103*a-c* which may be connectable using known connectors (e.g., screws, snap-fit connectors, bolts, rivets). The firestat 100 may further include a blade position lever 203 that is configured to be connectable to a blade and/or plurality of blades (e.g., as shown in FIGS. 1A-1B). In one example, the position lever 203 may provide feedback signals related to the position of the pivoting blades 51*a* and 51*b*. For example, the position lever 203 may move with the pivoting blades and provide an end-of-travel signal when the blades 51*a* and/or 51*b* are in a full opened or fully closed position. The feedback signal may be used to monitor the position of the blades and/or to provide feedback control for a blade position driving device (e.g., the electric, pneumatic, actuator used to open or close blades 51*a* and/or 51*b*). The electric, pneumatic actuator and controlling system may be any known system in the art.

The firestat 100 may further include a first thermal sensor 300*a* and a second thermal sensor 300*b*. It is noted that throughout the disclosure the terms thermal sensor, thermal detector, detection device, and thermal fuse may be used interchangeably. The first thermal sensor 300*a* and the second thermal sensor 300*b*, may for example be a bimetallic sensor or bimetallic switch configured to be "tripped" or cause continuity or discontinuity between two terminals when the thermal sensor is exposed to a threshold temperature. In one example, the first thermal sensor 300*a* may for example be configured to be tripped when exposed to a first temperature and the second thermal sensor 300*b* may be configured to be tripped when exposed to a second temperature. In example, the first temperature will be lower than the second temperature. Thus allowing different outputs from the firestat once various temperature thresholds are reached. For example, when the aforementioned first temperature threshold is reached causing the first thermal sensor 300*a* to be tripped, the blocking mechanism (e.g., blades 51*a* and 51*b*) may be moved from an open position to a closed position temporarily and/or until a remote open signal is received; when a second threshold temperature is reached causing the second thermal sensor 300*b* to be tripped, the blocking mechanism may be moved to the closed position and may only be re-set manually by accessing the firestat. It is noted that while an example of a bimetallic switch or sensor is described above, any type of sensor or detector capable of detecting the temperature of an environment is applicable to the aspects of the disclosure discussed in further detail below.

Figure 4:
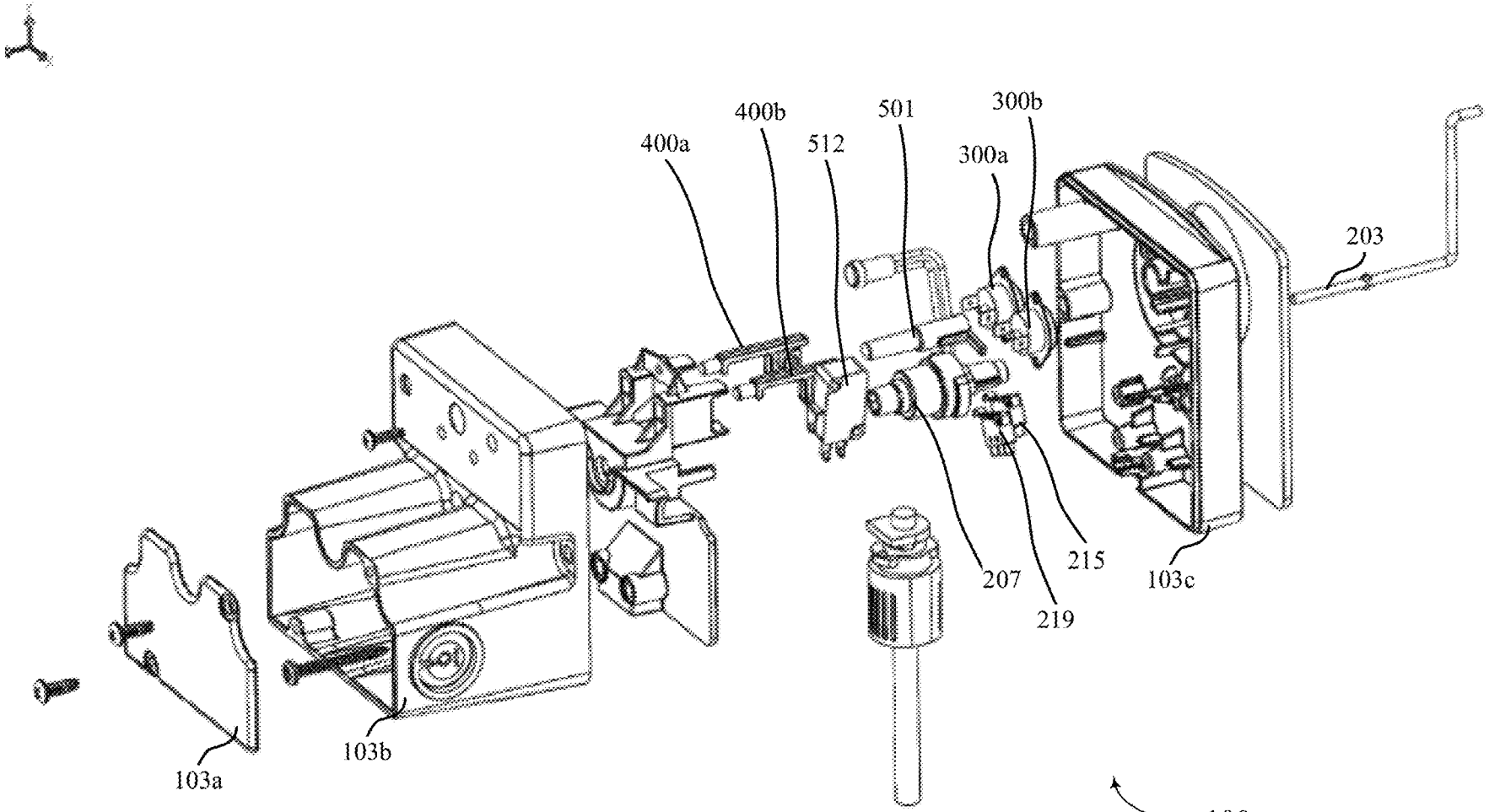
FIG. 4 is an exploded perspective view of the triggering device or firestat of FIGS. 2A, 2B, and 3 in accordance with one aspect of the disclosure.
Figure 5:
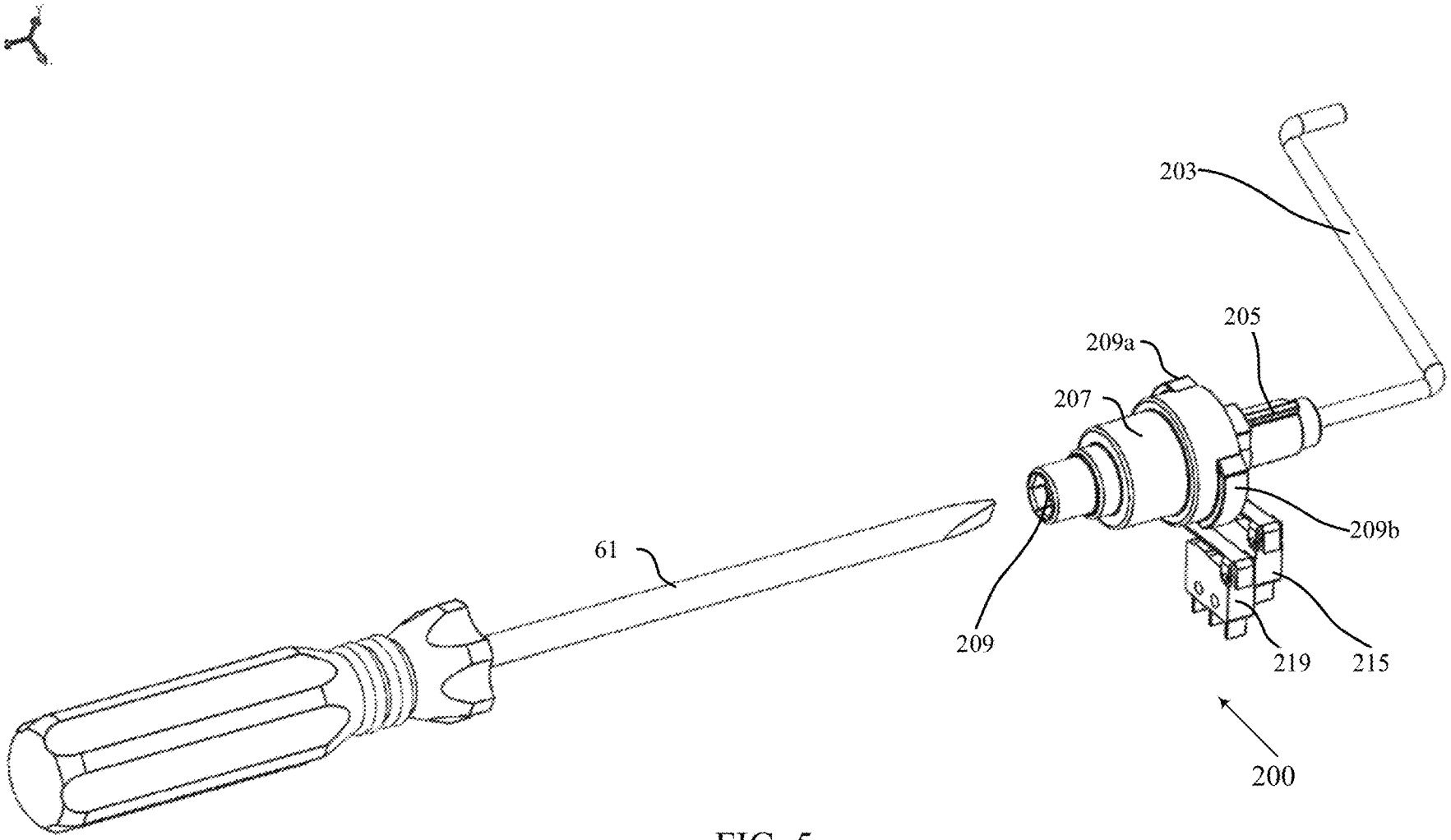
FIG. 5 is a left side, top perspective view of an adjustable cam assembly usable with the triggering device or firestat of FIGS. 2A, 2B, 3, and 4 in accordance with one aspect of the disclosure.

The firestat 100 may further include test switch 512 (FIG. 4). Test switch may for example allow for the testing of the system by a technician or other user. In one example, the test switch may in signal communication with a control system of the aforementioned electric, pneumatic, which may provide the opening and/or closing force to blades 51*a* and 51*b* in response to an open and/or close signal provided by an actuator controller (not shown). In a case of unexpected heat and/or fire which may for example melt or effect the integrity of the components in the firestat 100, it may be desirable to have a test switch configuration that is biased or would default to a blade closed position if the structural integrity of the components within the firestat is compromised due to unexpected heat and/or fire. The current disclosure provides a testing system which is configured to default and/or be biased in a blade closed position in such a case.

Figure 2A:
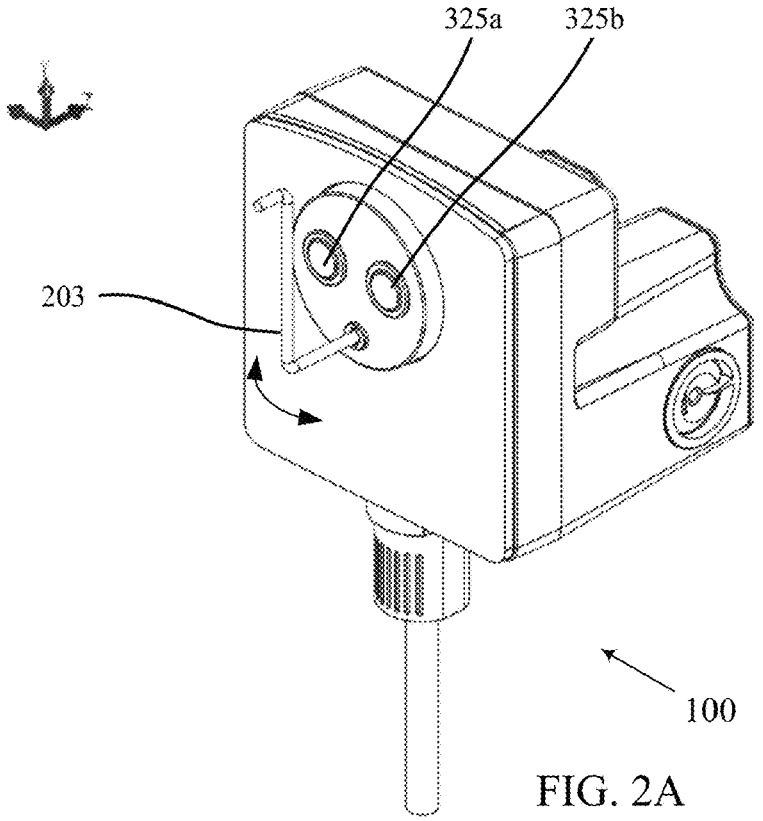
FIG. 2A is a rear perspective view of a triggering device or firestat in accordance with one aspect of the disclosure.
Figure 2B:
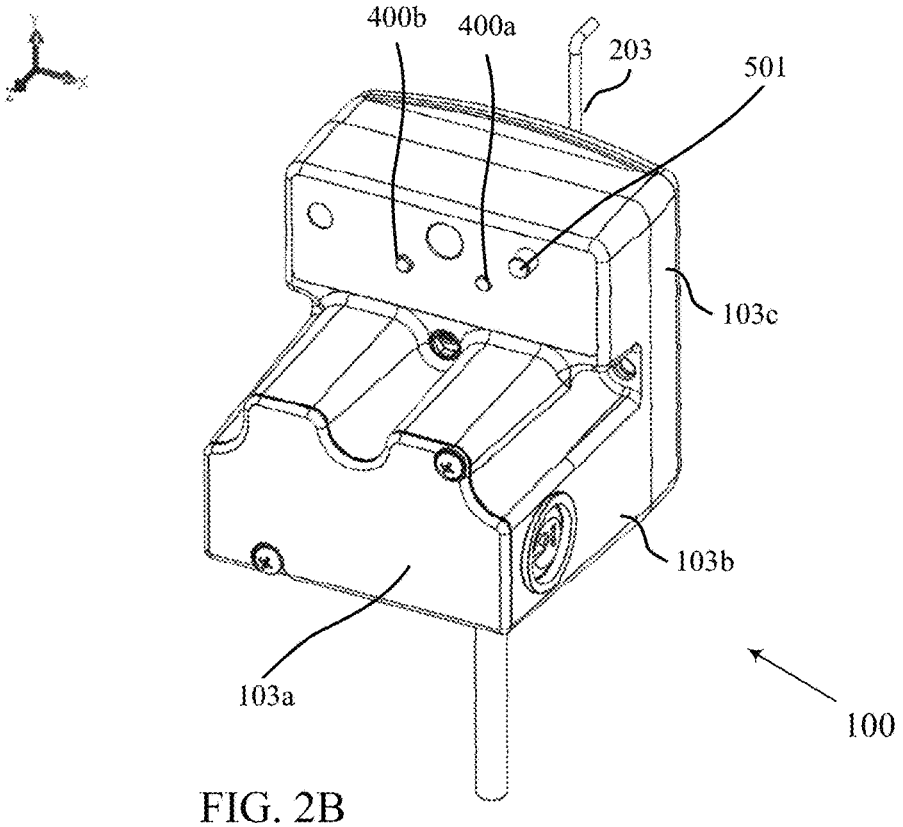
FIG. 2B is a front perspective view of the triggering device or firestat of FIG. 2A in accordance with one aspect of the disclosure.
Figure 3:
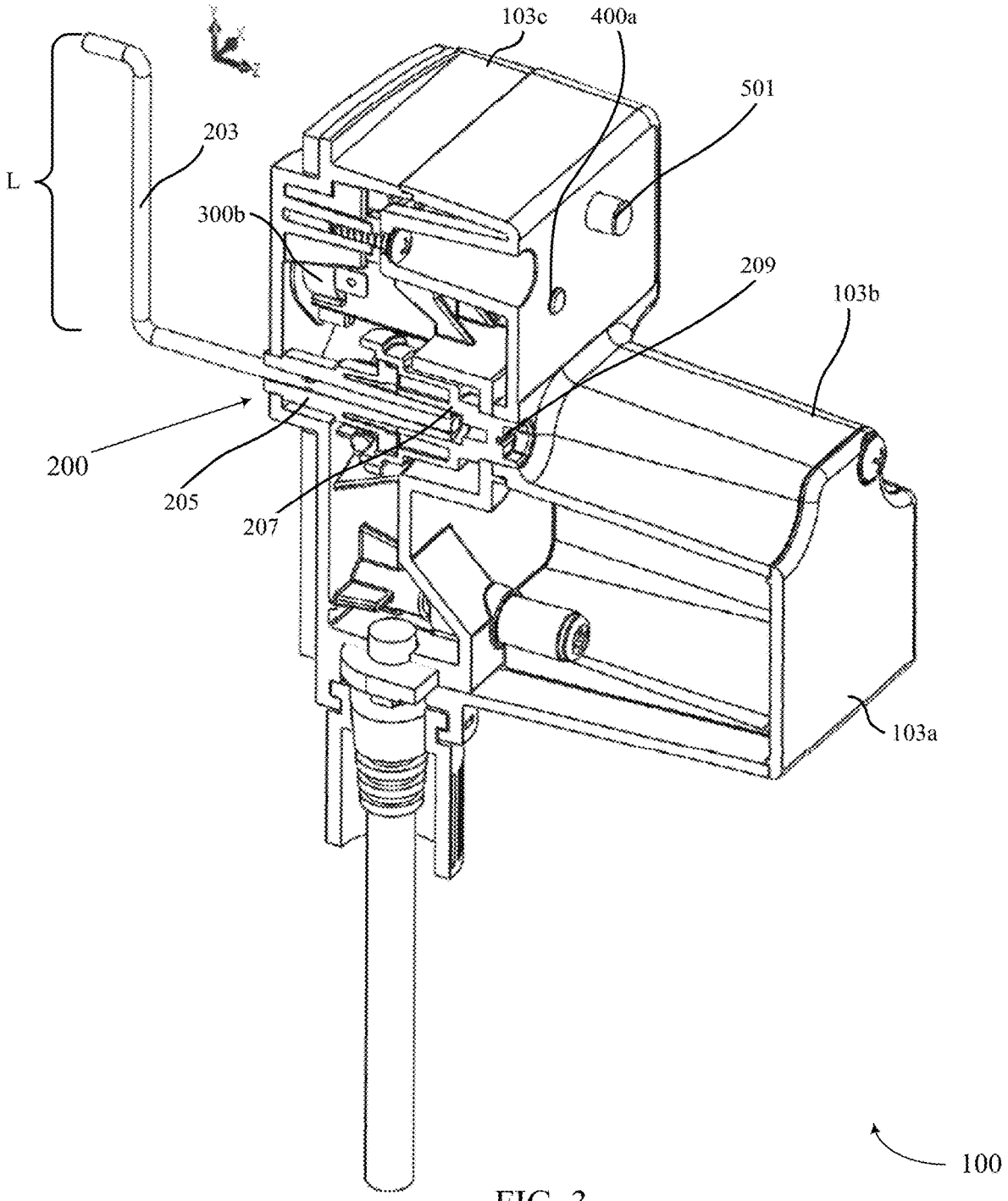
FIG. 3 is a side cut-away perspective view of the triggering device or firestat of FIGS. 2A-B in accordance with one aspect of the disclosure.

For example, the test switch 512 may normally be in an open position (e.g., with continuity provided through the switch) when the blades 51*a* and 51*b* are in an open position and/or in response to an open signal. However, when a user and/or technician wishes to test the functionality of the system, continuity may be interrupted at the switch and cause the actuator controller to close the blades 51*a* and 51*b* so that proper functionality of the system may be verified. It is noted that the aforementioned example is not intended to limit the functionality or test switch 512. The current disclosure is applicable to any known system of providing an open/closing test signal to an electric, pneumatic actuator. The test switch 512 may be mounted within the firestat 100 and may be configured to be depressed and/or released in response to a user and/or technician applying a pressing force to an actuator 501, which may protrude from the housing 103*b* of the firestat 100 (e.g., as shown in FIGS. 2B and 3).

As described in further detail below, in one example the actuator 501 may be configured to provide a pressing force to the test switch 512 when in a rest position. The test switch may further be configured to release the test switch 512 when a pressing force is applied to the actuator 501 from the portion of the actuator 501 protruding from the housing 103*b*. As described in further detail below, the aforementioned structure may provide additional assurance that the firestat 100 provides a blade closed signal in response to unexpected heat and/or fire that compromise the structure of the components within the firestat 100.

Adjustable Cam Assembly for Damper Position Feedback

One example of a challenge in setting up and/or installing a firestat within ductwork or a fire/smoke damper is that space and/or other constraints may require variation in the orientation and/or position of the firestat with relation to the blocking mechanism, e.g., pivoting blades 51*a* and 51*b*. One aspect of the disclosure provides an adjustable system that provides blade position feedback regardless of the orientation and/or positon of the firestat with relation to the blade. In another aspect, the adjustable system provides for increased efficiency in set-up and adjustment of the blade position feedback mechanism of the firestat.

Figure 6A:
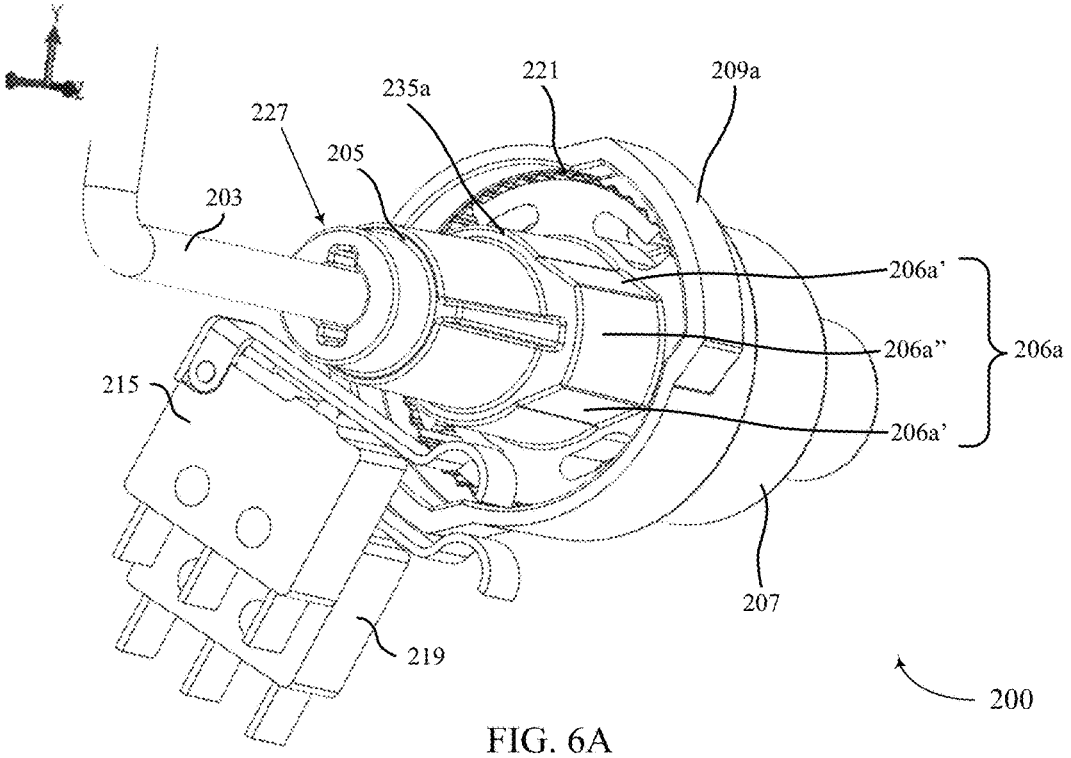
FIG. 6A is right side, bottom perspective view of the adjustable cam assembly of FIG. 5 in accordance with one aspect of the disclosure.
Figure 6B:
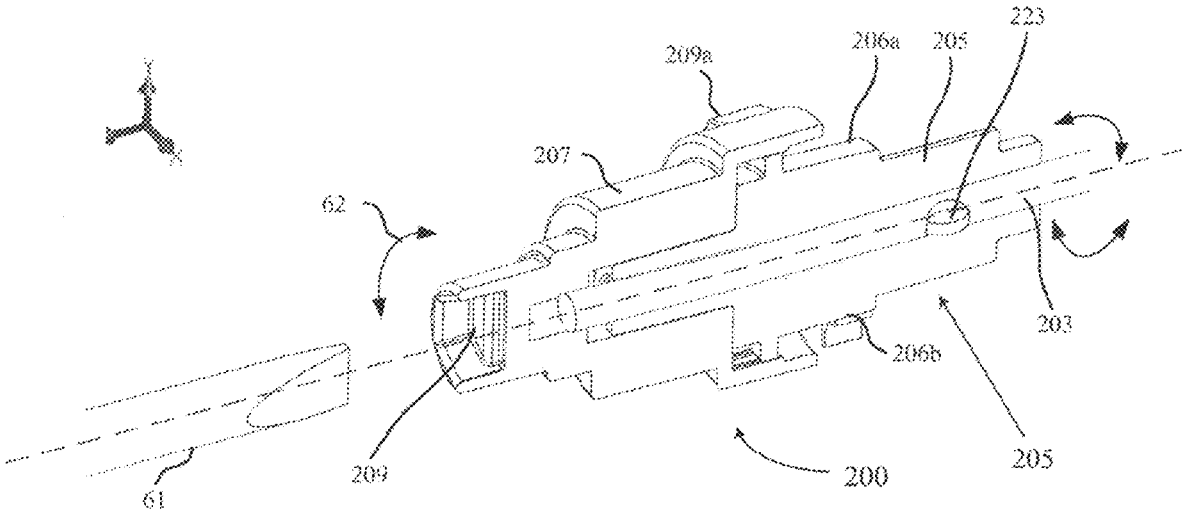
FIG. 6B is a cut-away left side perspective view of a portion of the adjustable cam assembly of FIGS. 5 and 6A in accordance with one aspect of the disclosure.

FIGS. 2A-B, 3, and 4 show examples of a firestat usable with the current disclosure. The firestat device may include outer casings 103*a-c*. The firestat 100 may further include a blade position lever 203 that is configured to be connectable to a blade and/or plurality of blades (e.g., as shown in FIGS. 1A-1B). The blade position lever 203 may be connected to a primary cam 205, which may hereinafter be interchangeably referred to as a second cam. As shown in FIG. 6B, the blade position lever 203 may for example be press fit and/or have a keyed portion 223 for preventing rotation of the blade position lever 203 with relation to the primary cam 205 when the key is installed into opening 227 (FIG. 6A) of the primary cam 205. The primary cam 205 includes a set of engagement protrusions 231 configured to engage with and a series of engagement grooves 221 of a secondary cam 207, which may hereinafter be interchangeably referred to as a first cam. The engagement protrusions 231 may be formed at end of elastic portions 232. As explained in further detail below, the elastic portions 232 may be configured to bias each of the engagement protrusions 231 in a radially outward direction when the primary cam 205 is within the secondary cam 207. The outward bias of the engagement protrusions 231 by the elastic portions 232 may cause the engagement protrusions to engage with the engagement grooves 221 thus preventing unwanted rotation of the secondary cam 207 on the primary cam 205. However, when a user rotates the secondary cam 207, for example with a screwdriver 61, in either direction 62 (FIG. 6B), the rotational force in direction 62 may overcome the holding force of the elastic portions 232, thus allowing the engagement the engagement protrusions to move from a first series of engagement grooves to a second series of engagement grooves. The interaction between the engagement grooves 221 with the engagement protrusions 231 allow the orientation of the secondary cam 207 to be fixed with relation to the primary cam 205 until a user provides a rotational force sufficient to rotate the secondary cam 207 with relation to the primary cam 205 or vice versa.

Figure 7A:
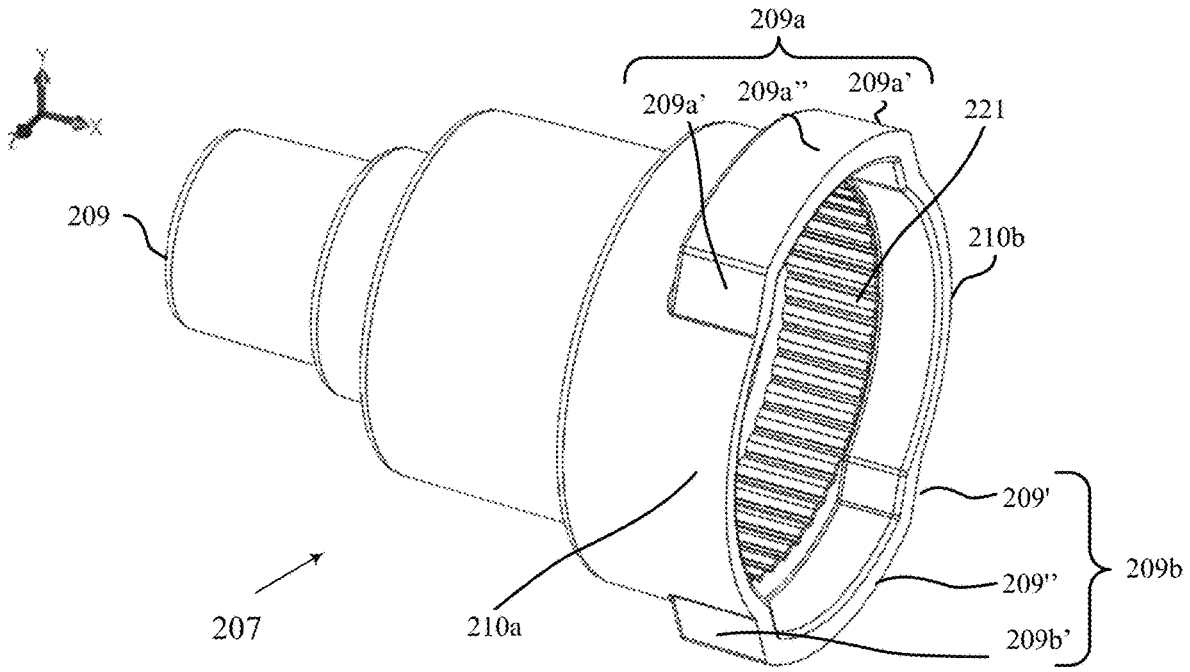
FIG. 7A is a side perspective view of a secondary cam of the adjustable cam assembly of FIGS. 5 and 6A-B in accordance with one aspect of the disclosure.
Figure 7B:
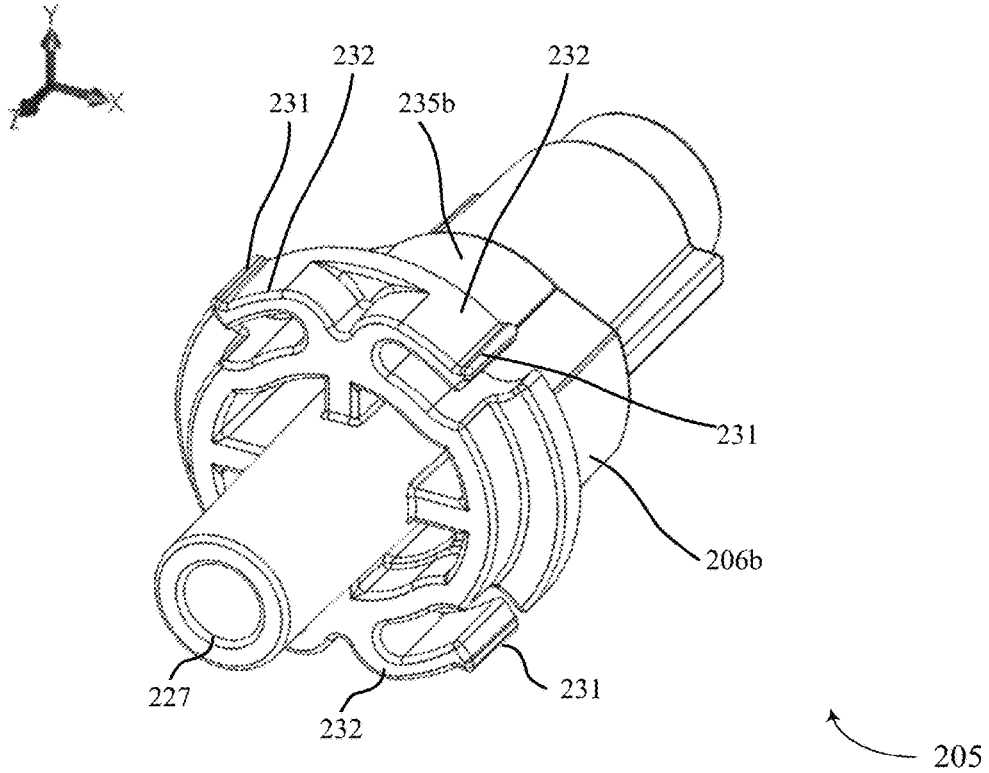
FIG. 7B is a side perspective view of a primary cam of the adjustable cam assembly of FIGS. 5, 6A-B, and 7A in accordance with one aspect of the disclosure.

The primary cam 205 further includes a pair of engagement regions 206*a-b* and a pair of disengagement regions 235*a-b*. Each of the engagement regions 206*a-b* may be formed as a raised portion with substantially constant outer radius (e.g., 206*a*" in FIG. 6A; 206*a*" and 206*b*" in FIG. 9D) that is greater than that of the disengagement regions 235*a-b* and, wherein the engagement regions 206*a-b* have a first sloped portion and a second sloped portion (e.g., 206*a*' in FIG. 6A; 206*a*' and 206*b*' in FIG. 9D) leading up to the raised portion of the engagement regions 206*a-b*. The engagement regions 206*a-b* are configured to contact and engage a primary limit or end-of-stroke switch 215. Further, the first sloped portion and the second sloped portions 206*a*' and 206*b*' leading up to the raised portions 206*a*" and 206*b*" of engagement regions 206*a-b* may be formed as a gradual slope and/or a slightly curved or chamfered surface to prevent deflection of an actuator end of stroke switch 215 so as to prevent damage or excessive wear to the end of stroke switch 215. Further, the outer radius of the engagement regions 206*a-b* may be set so that over-travel and/or damage to the actuator switch 215 is avoided. It Throughout the disclosure the pair of engagement regions 206*a-b* may be interchangeably referred to as a third contact portion and a fourth contact portion, respectively. The disengagement regions 235*a-b* (FIG. 9D) are configured to not contact and/or to disengage the primary limit or end-of-stroke switch 215. The secondary cam 207 further includes a pair of engagement regions 209*a-b* and disengagement regions 210*a-b* (FIG. 9C). The engagement regions 209*a-b* are configured to contact and engage a secondary limit or end-of-stroke switch 219. Each of the engagement regions 209*a-b* may be formed as a raised portion with substantially constant outer radius (e.g., 209*a*" and 209*b*" in FIGS. 7A and 9C) that is greater than that of the disengagement regions 210*a-b* and, wherein the engagement regions 209*a-b* have a first sloped portion and a second sloped portion (e.g., 209*a*' and 209*b*' in FIGS. 7A and 9C) leading up to the raised portion of the engagement regions 209*a-b*. Further, the first sloped portion and the second sloped portions 209*a*' and 209*b*' (FIGS. 7A and 9C) leading up to the raised portion of engagement regions 209*a-b* may be formed as a gradual slope and/or a slightly curved or chamfered surface to prevent deflection of an actuator end of stroke switch 219 so as to prevent damage or excessive wear to the end of stroke switch 219. Further, the outer radius of the engagement regions 209*a-b* may be set so that over-travel and/or damage to the actuator switch 219 is avoided It is noted that throughout the disclosure the pair of engagement regions 209*a-b* may be interchangeably referred to as first and second contact portions, respectively. The disengagement regions 210*a-b* (FIG. 9C) are configured to not contact and/or to disengage the secondary limit or end-of-stroke switch 219.

Figure 8A:
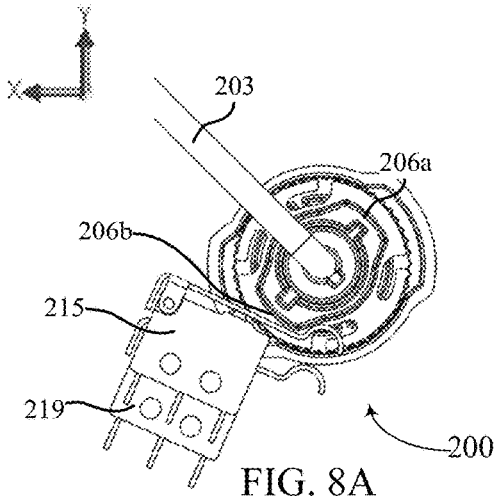
FIGS. 8A-8E are side views of the adjustable cam assembly of FIGS. 5 and 6A in various states of operation in accordance with one aspect of the disclosure.
Figure 8B:
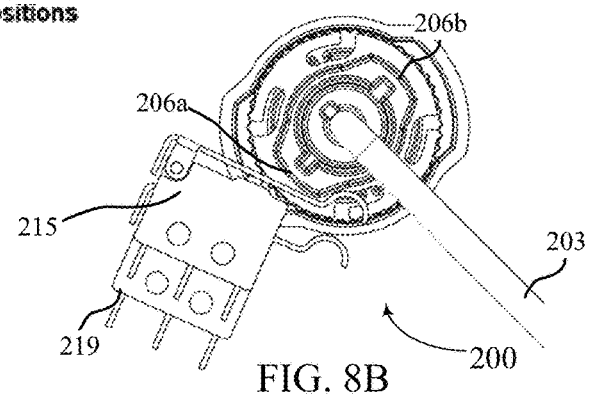
Figure 8C:
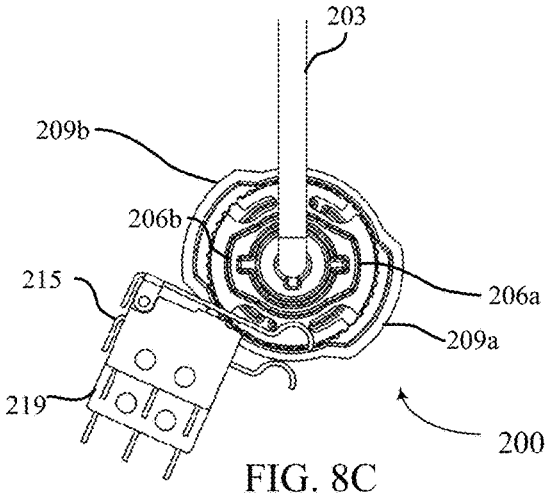
Figure 8D:
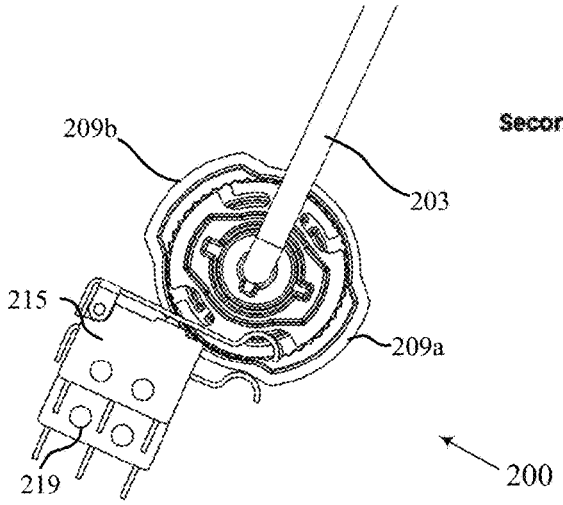
Figure 8E:
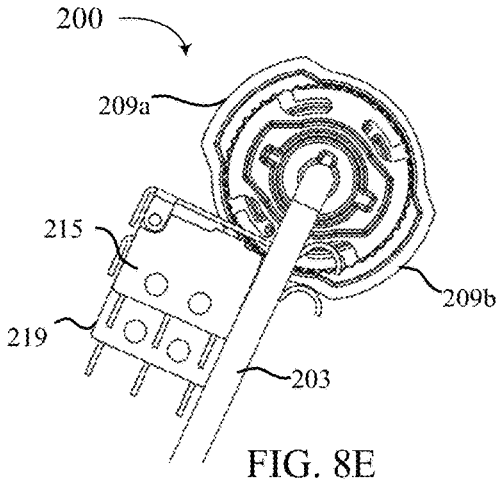

As mentioned above, the rotational relationship between the primary cam 205 and the secondary cam 207 may be adjusted by a user. Thus, the engagement region 206*a-b* of the primary cam 205 and the engagement regions 209*a-b* of the secondary cam 207 may be adjusted to engage or contact a respective end-of-stroke switches 215 and 219 so that a firestat containing the cam mechanism and aforementioned limit or end-of-stroke switches may be adapted to properly signal an end-of-stroke for multiple different configurations and positional relationships between the firestat 100 and a blocking mechanism, e.g., pivoting blades 51*a* and 51*b* (FIGS. 1A and 1B). FIGS. 8A-8E show examples of various positions of the blade position lever 203 cam mechanism. For example, FIG. 8A shows one example position of a blade position lever 203 and FIG. 8B shows a second example of a blade positon lever 203. In both of the aforementioned positions of the blade position lever 203, at least one of a first sloped portion and a second sloped portion (e.g., 206*a*' in FIG. 6A; 206*a*' or 206*b*' in FIG. 9D) of the engagement regions 206*a* or 206*b* is contacting and engaged with the primary limit or end of stroke switch 215. Similarly, as shown in the non-limiting examples of FIGS. 8D and 8E, the cam system 200 may be adjusted so that a first position of the blade position lever 203 (e.g., as shown in FIG. 8D) and a second position of the blade position lever 203 (e.g., as shown in FIG. 8E), both result in one of the a first sloped portion and a second sloped portion (e.g., 209*a*' or 209*b*' in FIGS. 7A or FIG. 9C) of engagement regions 209*a* or 209*b* contacting and in engagement with the secondary limit or end of stroke switch 219. Thus, during installation or assembly of the fire/smoke damper system, a positional relationship between the firestat 100 and the blocking mechanism, e.g., pivoting blades 51*a* and 51*b* (FIGS. 1A and 1B) is fairly flexible since multiple positions of the blade position lever would result in the same end-of-stroke signal being generated by the primary end-of-stroke switch 215 and/or the secondary end-of stroke switch 219.

Figure 9A:
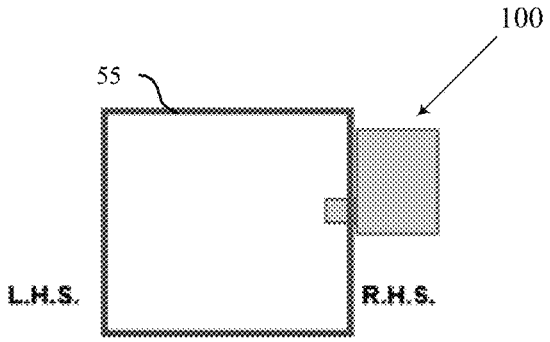
FIGS. 9A-9B are simplified plan views of example mounting locations of the triggering mechanism of FIGS. 2A-B, 3, and 4 in accordance with one aspect for the disclosure.
Figure 9B:
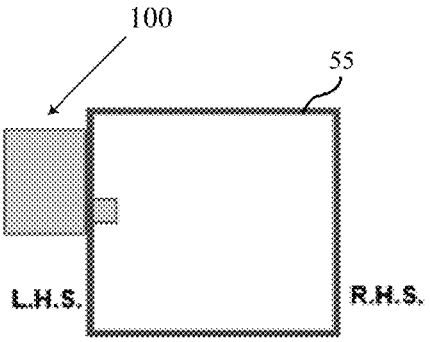
Figure 9C:
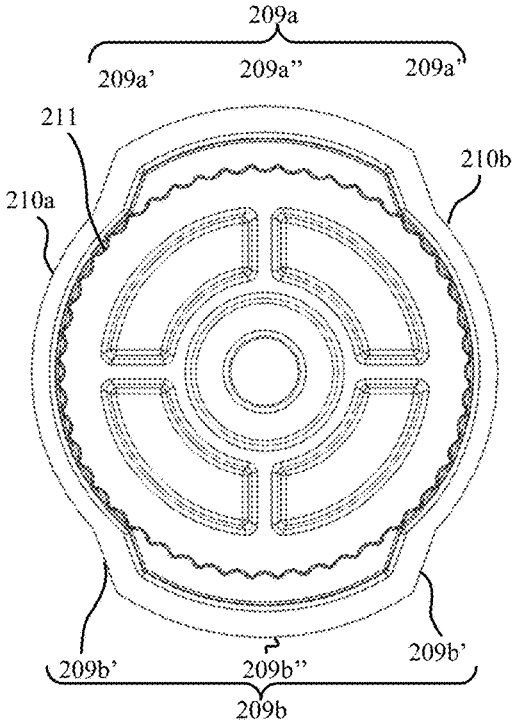
FIG. 9C is a end view of the secondary cam of FIGS. 5, 6A-B, and 7A and FIGS. 8A-8E, in accordance with one aspect of the disclosure.
Figure 9D:
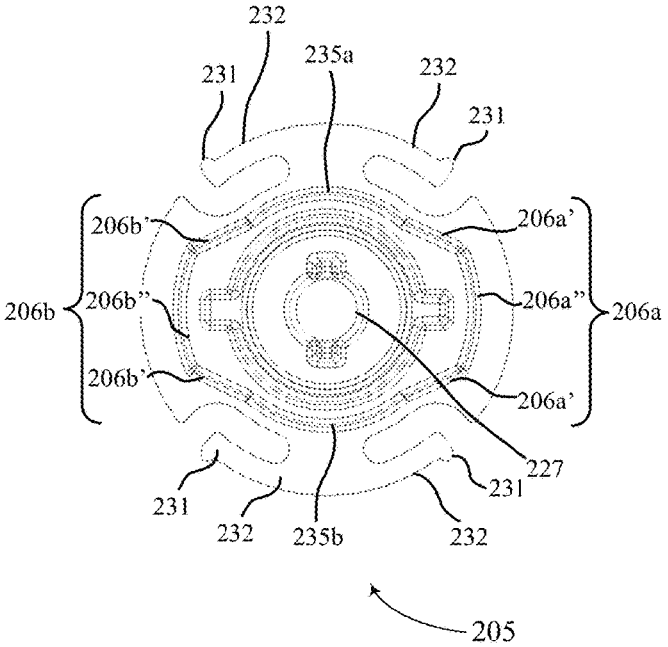
FIG. 9D is a end view of the primary cam of FIGS. 5, 6A-B, and 7B, and FIGS. 8A-8E, in accordance with an aspect of the disclosure.

As another example, as shown in FIGS. 9A and 9B, a firestat containing the aforementioned cam mechanism 200 could be mounted on a right hand side or a left hand side of a duct or wall of a damper system. In addition, a firestat containing the aforementioned cam mechanism 200 could be easily adjusted to function properly with different blocking mechanisms (e.g., types or sizes of blades), which may have varying rotational distances required to move from a fully open position (e.g., as shown in FIG. 1A) to a fully closed position (e.g., as shown in FIG. 1B).

Figure 10:
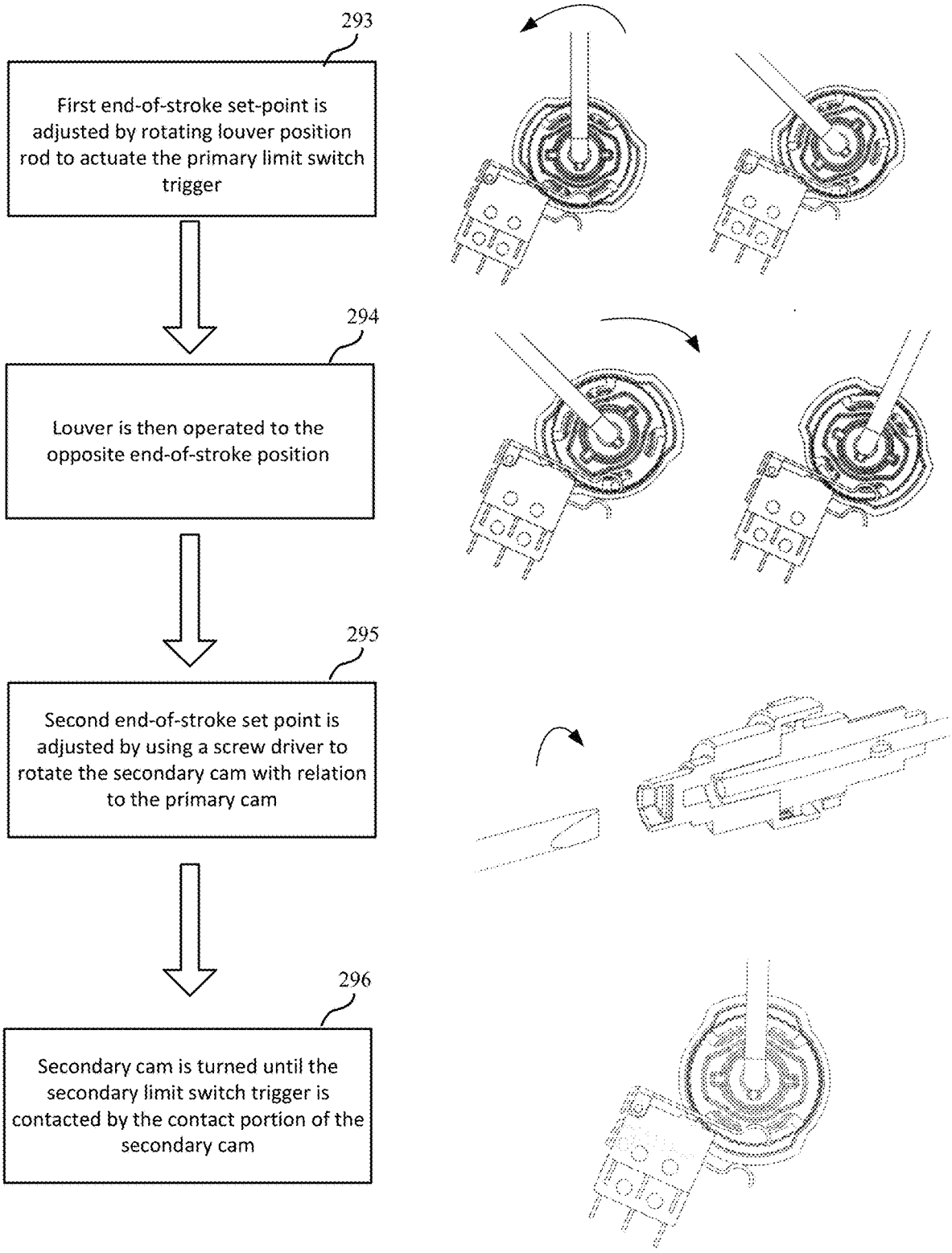
FIG. 10 is a flowchart and corresponding side views of one example method of adjusting a first end-of-stroke and second end-of-stroke via the adjustable cam assembly of FIGS. 5, 6A-B, 7A-B, 8A-E, and 9A-C.

FIG. 10 shows one example of a method of setting a first end-of-stroke set point and a second end-of-stroke set point of the cam mechanism 200. In one example, a first end-of-stroke set point may be an open position of a blocking mechanisms (e.g., open position of blades shown in FIG. 1A) and a second end-of-stroke set point may be a closed position of a blocking mechanism (e.g., closed position of blades shown in FIG. 1B). Conversely, in another example, the first end-of-stroke set point may be a closed position of a blocking mechanisms (e.g., closed position of blades shown in FIG. 1B) and a second end-of-stroke set point may be an open position of a blocking mechanism (e.g., open position of blades shown in FIG. 1A). As shown in step 293, a first end of stroke set point may be adjusted by rotating the blade position lever 203 until the engagement region (e.g., 206*a* or 206*b* in FIG. 9D) of the primary cam 205 contacts and engages with the primary limit or end of stroke switch 215. Once, the primary limit or end of stroke switch is contacted, the blocking mechanism (e.g., blade shown in FIGS. 1A and 1B) is operated moved or rotated to the opposite end of stroke position as shown in step 294. The blade is then held or biased in the aforementioned end of stroke position and a screw driver is used to rotate the secondary cam 270 with relation to the primary cam 205 until the secondary or end of stroke switch 219 is contacted or engaged by one of the two engagement regions 209*a* or 209*b* as shown in steps 295 and 296. By using the example procedure above, the end-of-stroke positions of the blade may be easily adjusted so that the firestat can provide proper feedback signals to an electric, pneumatic, actuator that is capable of opening and closing the blades as necessary.

Further, in one aspect of the aforementioned disclosure, the arm length L (FIG. 3) of position lever 203 allows the cam assembly 200 to rotate through an angle of less than 90 degrees when the blades (e.g., 51*a* and 51*b* in FIGS. 1A and 1B) of damper 50 move from an open position (e.g., as shown in FIG. 1A) to a closed position (e.g., as shown in FIG. 1B). Thus if a first end of stroke position is set (e.g., a an open position of the blades) being detected when a first engagement region 206*a* of the primary cam contacts switch 215, the next engagement region 206*b* does not contact the switch 215 at the second end of stroke position (e.g., a closed position as shown in FIG. 1B). The angular displacement of engagement regions 206*a-b* on primary cam 205 is greater than the displacement of position lever 203 between the first end position and the second end position. Similarly the engagement regions 209*a-b* on secondary cam 207 are positioned at an angle greater than 90 degrees to prevent engagement of contact region 209 at the first end of stroke position after a contact region 209*a* or 209*b* of the secondary cam 207 is adjusted so as to contact switch 219 at the second endpoint (e.g., a closed position as shown in FIG. 1B). Due to the geometry of a blade crank arm 56 on the blocking mechanism or blade 51*b* (FIG. 1B) and the length L of position lever 203, contact between the a contact region 206*b* of the primary cam 205 and switch 215 is prevented at the aforementioned end of stroke position to prevent false engagement of either limit switch 215 and/or 219. In one aspect, the aforementioned geometry is such that a rotation of 90 degrees of the blade crank arm 56 results in a rotation of about 75 degrees of the blade position lever 203, for example. Thus, the aforementioned geometry allows for adjustment of both end of stroke positions while preventing false engagement of either limit switch 215 or 219 at both end positions due to contact with a second engagement region of each respective on of the primary cam and/or secondary cam.

Thermal Sensor Reset System

The firestat 100 may further include a first thermal sensor 300*a* and a second thermal sensor 300*b*. The first thermal sensor 300*a* and the second thermal sensor 300*b*, may for example be a bimetallic sensor or bimetallic switch configured to be "tripped" or cause continuity or discontinuity between two terminals when the thermal sensor is exposed to a threshold temperature. In one example, the first thermal sensor 300*a* may for example be configured to be tripped when exposed to a first temperature and the second thermal sensor 300*b* may be configured to be tripped when exposed to a second temperature. As mentioned above, in one example, the first temperature may be higher than the second temperature or vise-versa. Thus allowing different outputs from the firestat once various temperature thresholds are reached. For example, when the aforementioned first temperature threshold is reached causing the first thermal sensor 300*a* to be tripped, the blocking mechanism (e.g., blades 51*a* and 51*b*) may be moved from an open position to a closed position temporarily and/or until a remote open signal is received; when a second threshold temperature is reached causing the second thermal sensor 300*b* to be tripped, the blocking mechanism may be moved to the closed position and may only be re-set manually by accessing the firestat. It is noted that while an example of a bimetallic switch or sensor is described above, any type of sensor or detector capable of detecting the temperature of an environment is applicable to the aspects of the disclosure discussed in further detail below.

Figure 11:
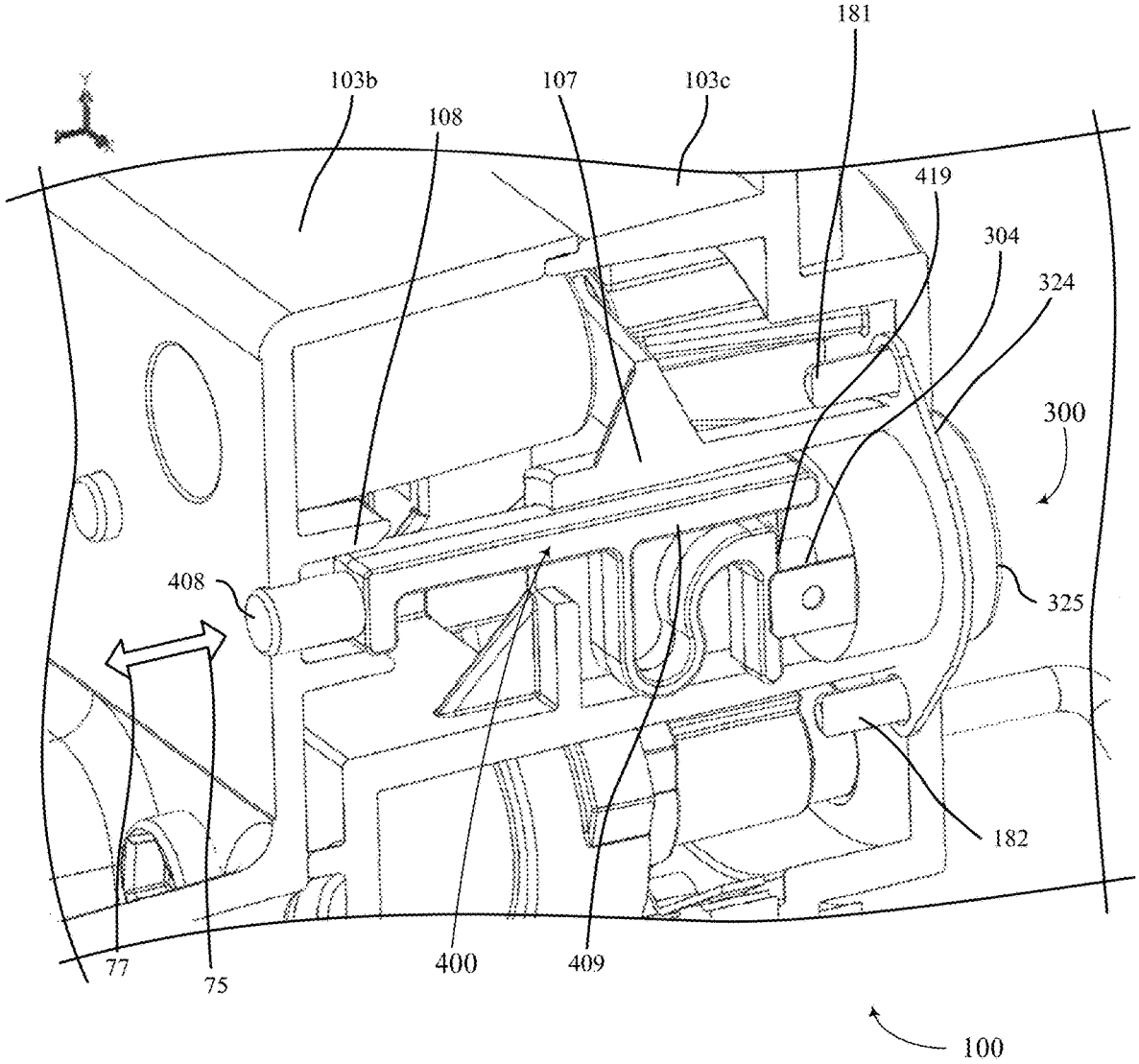
FIG. 11 is a cut-away, partial, perspective view of the triggering device of FIGS. 2A-B, 3, and 4 with a thermal sensor reset apparatus in accordance with one aspect of the disclosure.
Figure 12A:
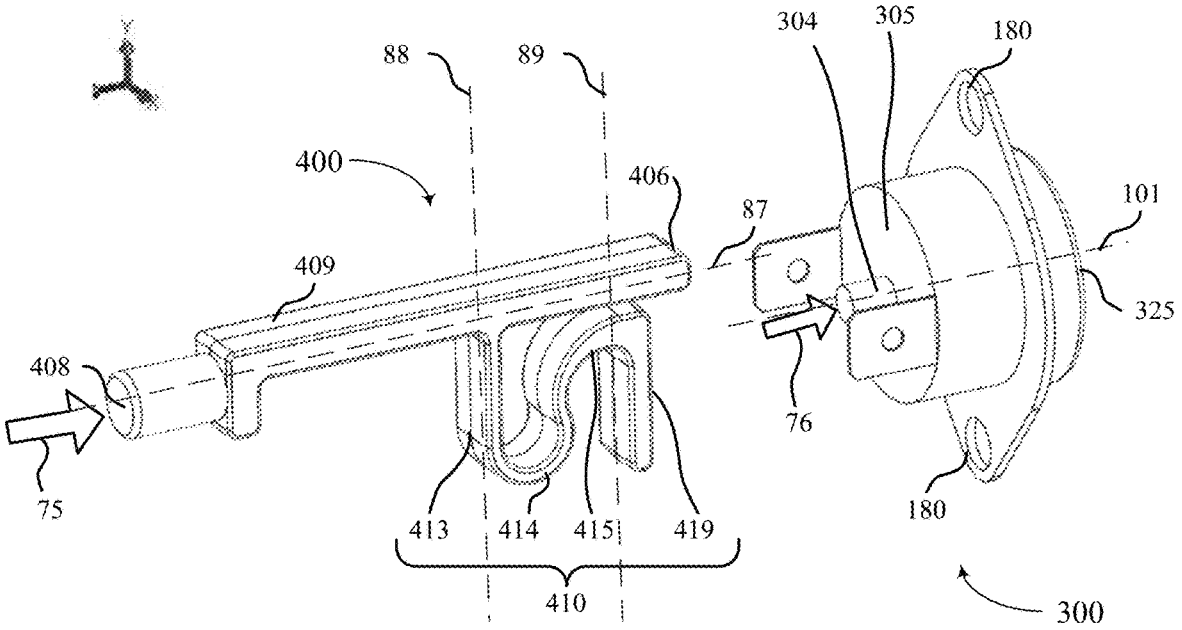
FIG. 12A is a first side perspective view of a thermal sensor and thermal sensor reset apparatus of FIG. 11 in accordance with one aspect of the disclosure.
Figure 12B:
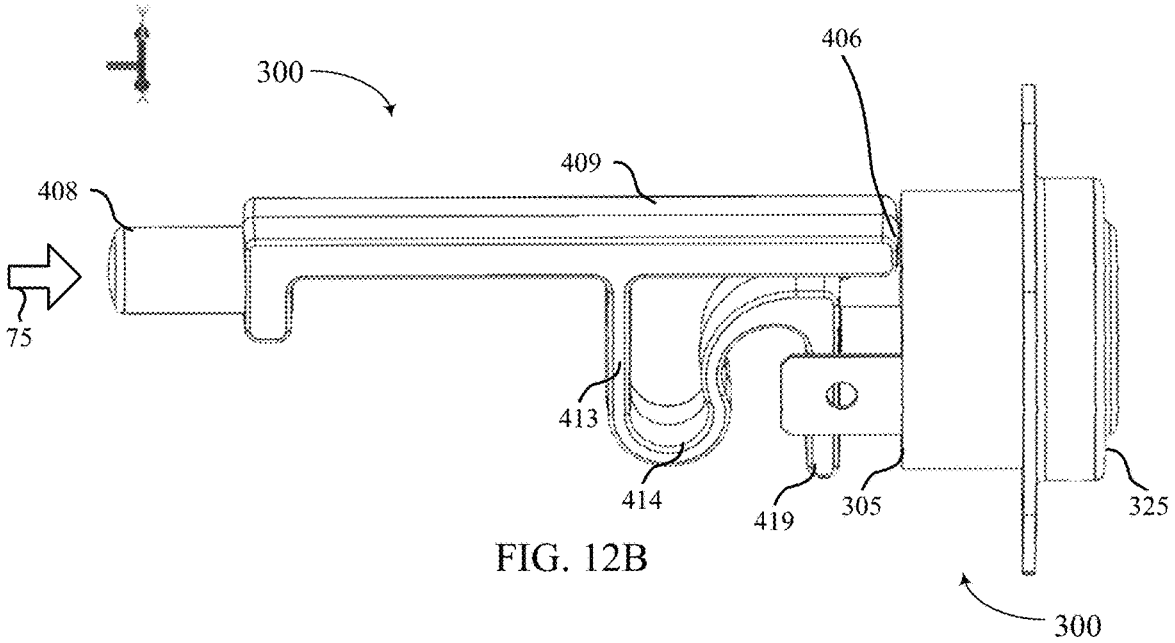
FIG. 12B is a second side perspective view of a thermal sensor and thermal sensor reset apparatus of FIGS. 11 and 12A in accordance with one aspect of the disclosure.
Figure 13:
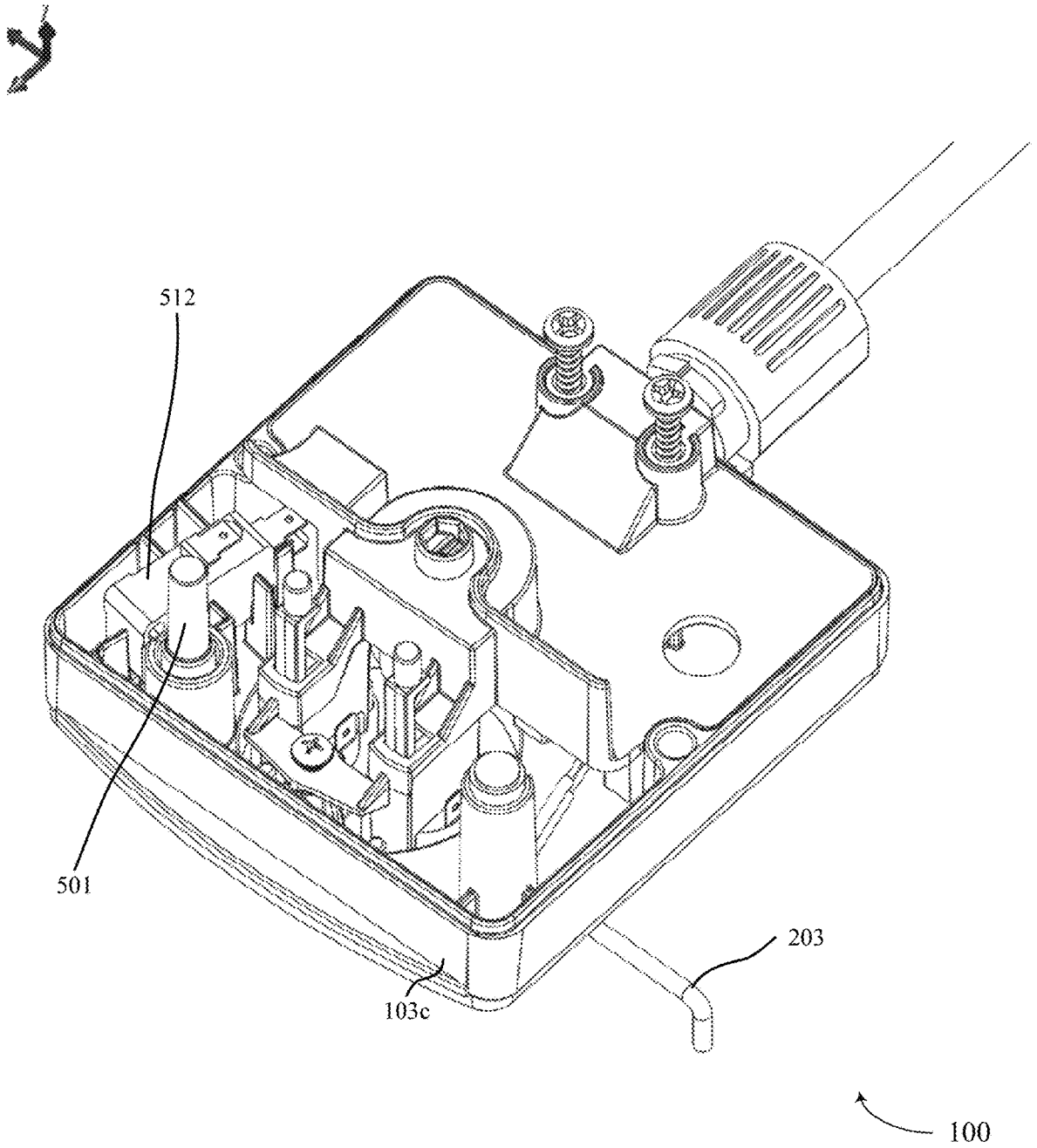
FIG. 13 is a cut-away perspective view of the triggering device shown in FIGS. 2A-B, 3, and 4 with a damper test button in accordance with one aspect of the disclosure.

FIGS. 11, 12A, and 12B show one example of the resetting elements 400*a* and/or 400*b*. While two resetting elements are shown in FIGS. 1-4, is noted that only a single resetting element or any number of resetting elements may be utilized. For simplicity, only a single resetting element 400 is shown in FIGS. 11, 12A, and 12B; however, it is noted that any one of or all of the features may be applicable to both resetting elements 400*a* and/or 400*b* in FIGS. 1A, 1B, 2B, and 4. A resetting element 400, may include an elongated body 409 that extends from a first end 408 to a second end 406. The elongated body 409 may extend substantially along a first axis (e.g., an axis 87 in FIG. 12A). The resetting element 400 may further include an elastic element 410. The elastic element may have an increased elasticity and may be flexible compared to the elongated body, and thus may be configured to partially absorb a force received at the first end 408 of the elongated body 409. Accordingly, the elongated body may more rigid or stiffer than the elastic element 410. In one aspect, the elastic element may include a first portion 413 that extends in a direction substantially perpendicular to the first axis (e.g., along axis 88 in FIG. 12A). In addition, the elastic element 410 may further include an abutment portion 419 configured to contact or selectively contact the reset switch 304 of thermal switch 300. The abutment portion may extend along a third axis (e.g., along axis 89 in FIG. 12A). The elastic element 410 may include a first curved portion 414 and a second curved portion 415 connecting the first portion 413 and the abutment portion 419. In one example, the first curved portion 414 and the second curved portion 415 may form an S-shape. The S-shaped portion may be flexible enough to absorb any impact or excessive force received at the first end 408 while still allowing enough force to be transferred from the first end 408 of the resetting element to the abutment portion 419 to depress reset switch 304 of the thermal switch 300. For example, a force 75 (FIGS. 12A and 12B) may be applied at first end 408, and the elastic element 410 may absorb some of the force so that the force 76 (FIG. 12A) applied to switch 304 by abutment portion 419 is decreased. Thus, the resetting element 400 may prevent damage to the thermal switch 300 due to excessive force received at first end 408. In one example, the aforementioned features may prevent the firestat from being damaged during transportation or packaging, to name a few non-limiting examples. As shown in FIGS. 12A and 12B, the thermal switch 300 may include a reset switch 304 that extends along and is configured to move along a switch axis 101. In one aspect the switch axis is spaced apart from the first axis 87. In one aspect, the first axis 87 and the switch axis 101 may be parallel.

In addition to the aforementioned features, the second end 406 of the resetting element 400 may further be configured to contact a housing 305 (e.g., as shown in FIG. 12B) of the thermal switch 300 before a force exceeding a maximum force (e.g., a force that may cause damage to the thermal switch 300) is supplied to the switch 304. In another example, the combination of the aforementioned elastic element and the ability of the second end 406 to contact housing 305 greatly reduces the chance that the thermal switch 300 is damaged due to excessive force being supplied to resetting switch 304. In one aspect, the abutment portion 419 of elastic portion 410 may transfer a spring force to the switch 304 when movement of the second end 406 of the elongated body is limited due to contact with housing 305 of thermal switch 300.

As shown in FIG. 11, the resetting element 400 may be contained within the housing of the firestat 100 with the first end 408 protruding from the rear of the firestat housing 103*b*. The resetting element 400 may be mounted to as to be contained within the housing while still being able to slide along a first direction (e.g., the Z-axis in FIG. 11). For example, the firestat 100 may include a first receiving portion 108 and a second receiving portion 107 for slideably containing the resetting element 400 so that the abutting portion 419 is capable of contacting the resetting switch 304 of the thermal switch 300. In addition, the first receiving portion 108 and the second receiving portion 107 may be configured to slideably contain the resetting element 400 so that the second end is capable of contacting a housing 305 (FIGS. 12A-B) of the thermal switch 300.

Thus, via the aforementioned arrangement, if the thermal switch 300 is "triggered" due to being exposed to a heat higher than the switching threshold of the thermal switch 300, the reset switch 304 may extend from the thermal switch 300 causing the resetting element to move in direction 77 (FIG. 11). The reset switch 304 and resetting element 400 may remain in the extended position until a resetting force is applied in direction 75 to the resetting element. Once the resetting force is applied to resetting element 400, the resetting switch 304 is pressed into the housing 305 of the thermal switch 300 causing the thermal switch to reset.

As shown in FIG. 11, the housing 103*c* may include a holding portion 181 for mounting of the thermal switch or thermal sensor 300. In one example, the holding portion 181 may be comprised of protrusions that are configured to be received by openings 180 (FIG. 12A) of the thermal switch 300. For example, the protrusions may be dimensioned to have a press-fit or interference or slip fit with the openings 180 of the thermal switch 300. Further, the housing 103*c* may include an opening 324 for receiving a sensing portion 325 so that the sensing portion 325 is exposed to an environment inside a duct (e.g., as shown with Sensor 300*a* and 300*b* in FIGS. 1A and 1B).

Damper Test Switch Fail-Safe Actuator

As shown in FIGS. 2A-B, 3, and 4 and 13, 14A-B, and 15A-B, The firestat 100 may further include a test switch 512 (FIG. 4). As mentioned above, the test switch 512 may for example allow for the testing of the system by a technician or other user. In one example, the test switch may in signal communication with a control system of the aforementioned electric, pneumatic, actuator, which may provide the opening and/or closing force to blades 51*a* and 51*b* in response to an open and/or close signal provided by an actuator controller (not shown).

Figure 14A:
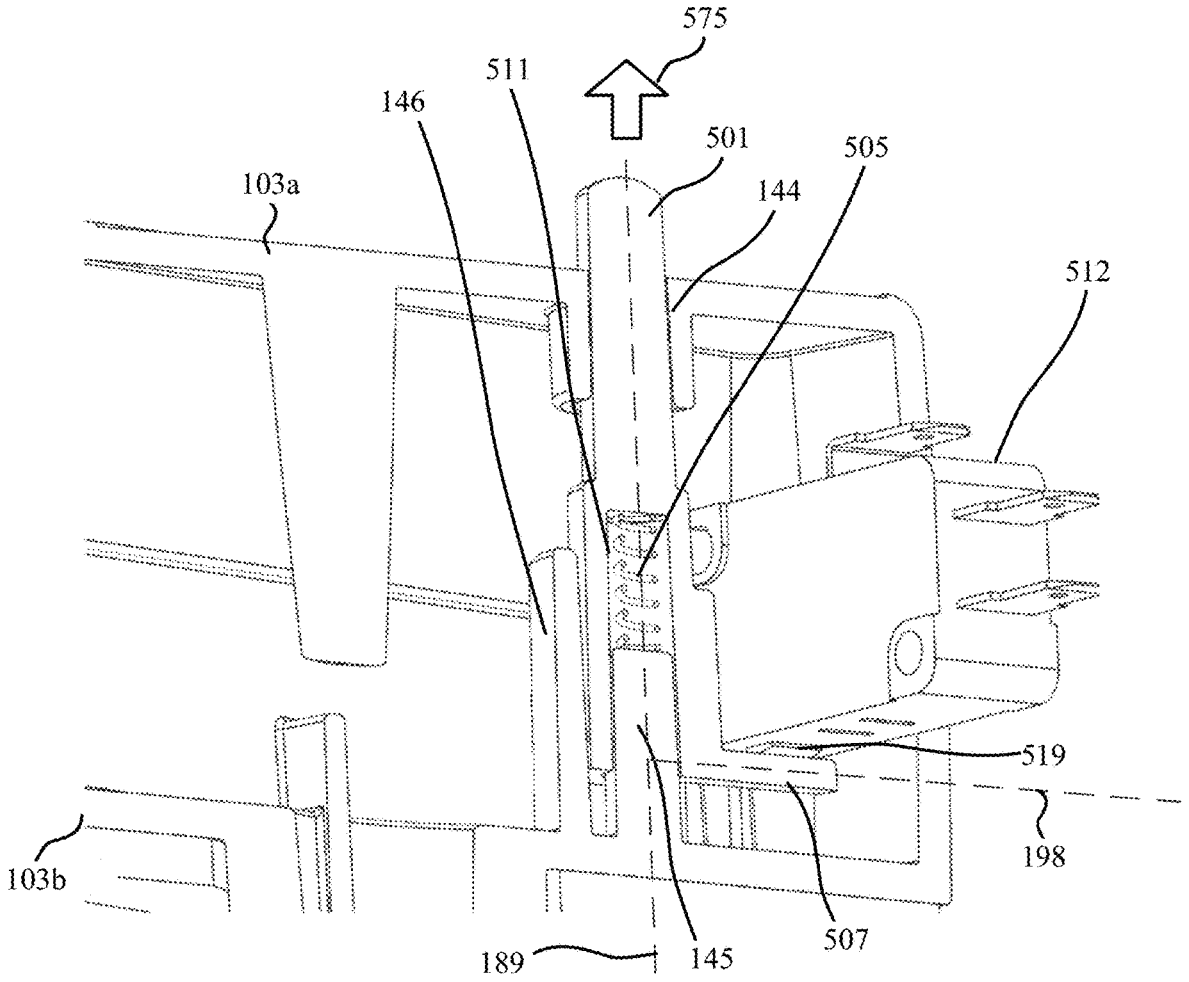
FIG. 14A is a side cut-away perspective view of the triggering device shown in FIGS. 2A-B, 3, 4 and 13 with a damper test button in a first state of operation in accordance with one aspect of the disclosure.
Figure 14B:
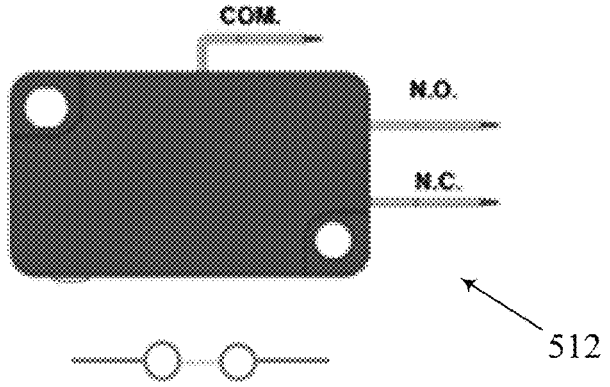
FIG. 14B is a simplified plan view of a damper test button relay in the first state of operation in accordance with one aspect of the disclosure.

Turning to FIGS. 13, 14A-B, and 15A-B, the test switch 512 may normally be in a closed position (e.g., as shown in FIG. 14B, with continuity provided through the switch 512 allowing a current to pass therethrough) when the blades 51*a* and 51*b* (FIGS. 1A-B) are in an open position and/or in response to an open signal. However, when a user and/or technician tests the system, e.g., to determine if blades 51*a* and 51*b* are capable of properly closing), the continuity may be broken at the switch 512 so that current does not pass therethrough (e.g., as show in in FIG. 15B) thus causing the actuator controller to close the blades 51*a* and 51*b*. The aforementioned example is not intended to limit the functionality or test switch 512. The current disclosure is applicable to any known system of providing an open/closing test signal to an electric, pneumatic, actuator.

Figure 15A:
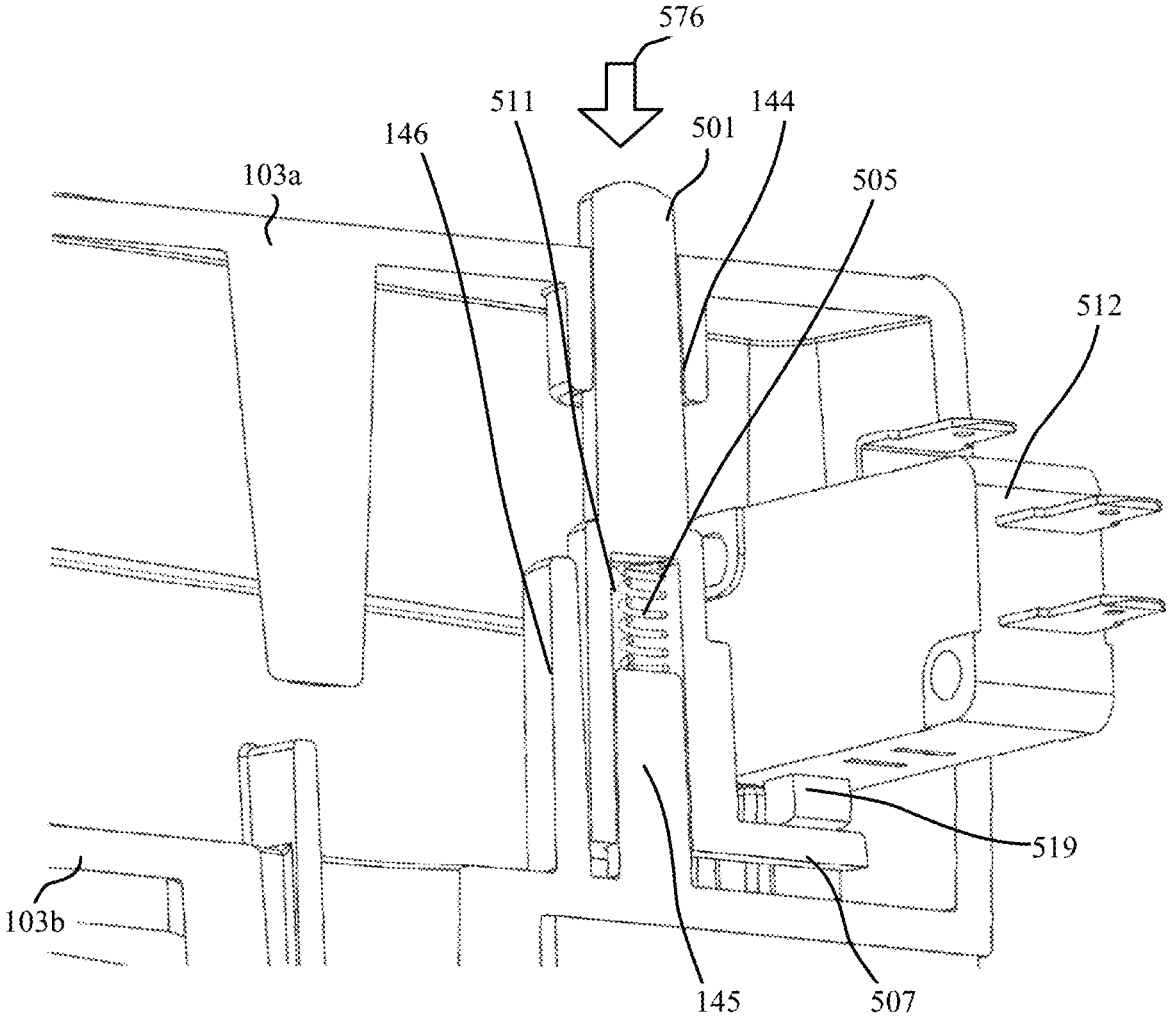
FIG. 15A is a side cut-away perspective view of the triggering device shown in FIGS. 2A-B, 3, 4, 13, and 14A with a damper test button in a second state of operation in accordance with one aspect of the disclosure.

The test switch 512 may be mounted within the firestat 100 housing as shown in FIGS. 14A and 14B. A button 519 of the test switch may be configured to be depressed (e.g., as show in in FIG. 14A) or released (e.g., as shown in FIG. 15A) by an actuator 501.

The actuator 501 may be formed as an elongated body that extends along a first axis (e.g., axis 189 in FIG. 14A). The actuator 501 may further include a cavity 511 for receiving a biasing member 505. As shown in the example in FIGS. 14A and 15A, the biasing member 505 may for example be a spring. The actuator 501 may further include a contacting portion 507 configured to selectively depress or activate button 519 of the test switch 512. In the example shown in FIGS. 14A and 14B, the contacting portion 507 may extend along second axis (e.g., axis 198) that is substantially perpendicular to the first axis 189. The cavity 511 of the actuator 501 may be configured to slidably receive a protrusion 145 of the housing 103*b* of firestat 100. Further, the housing 103 may include an actuator receiving portion 144, which may for example be an opening in the housing that is dimensioned to receive an outer surface (e.g., 144) of the actuator 501. The interaction between the actuator receiving portion 144 and the outer surface of the actuator 501 in conjunction with the interaction of the protrusion 145 with cavity 511 may allow the actuator to translate along the first axis 189. In addition, the interaction between the cavity 511 and the protrusion 145 may be configured to contain the biasing member 505 thus causing the actuator 501 to be biased in a first direction (e.g., direction 575 in FIG. 14A). The bias of the actuator 501 in the first direction 575 may additionally cause the contacting portion 507 to contact and depress the button 519 of the switch 512. Thus, button 519 of the switch may remain depressed when actuator 501 is in a resting state. As discussed above, in one example, depressing the button 519 of the switch 512 may cause the switch to be in a closed state, as shown in FIG. 14B, allowing current to pass though the switch 512. In the aforementioned example, continuity in switch 512 may signal a controller (not shown) to open or allow the blades (e.g., 51*a* and 51*b* in FIG. 1A) or other blocking mechanism of a fire/smoke damper to open and/or remain open.

Figure 15B:
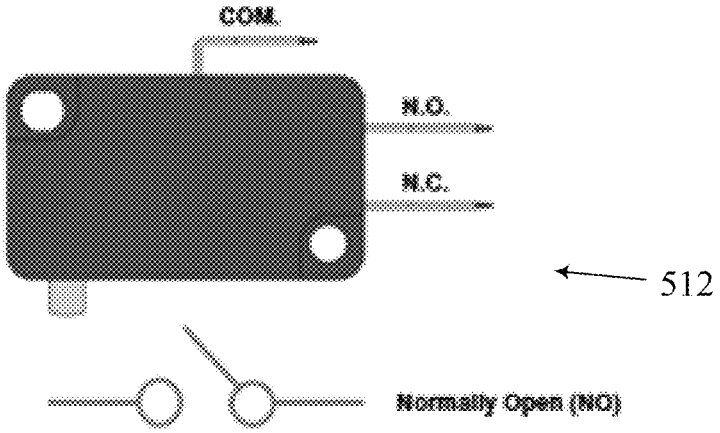
FIG. 15B is a simplified plan view of a damper test button relay in the second state of operation in accordance with one aspect of the disclosure.

Conversely, if a user or technician wishes to test the closing of the damper system, a second force or depressing force, for example a force in direction 576 (FIG. 15A) may be applied to the actuator 501. The force 576 may overcome the biasing force of biasing member 505 and cause the contacting portion 507 of the actuator 501 to release button 519 of switch 519. Release of the button 519 of the switch 519 may cause a break in continuity in the switch (e.g., as shown in FIG. 15B), which may signal the controller system to close the blades or blocking mechanism (e.g., as shown in FIG. 1B).

However, if the actuator 501 is subject to excessive heat (e.g., in the case of a fire), and the structural integrity of the actuator 501 is compromised, for example due to melting of the actuator 501, the contacting portion 507 of the actuator no longer applies a bias in the first direction 575 to button 519. Thus, the aforementioned construction provides an additional fail-safe that may cause the damper blocking mechanism to close if the firestat 100 and/or actuator 501 is damaged due to excessive heat. It is noted that melting or other damage (e.g., such as cracking, fracturing, or derailing) of the actuator 501 may hereafter be interchangeably referred to as a destructive condition. Further, it is noted that the term destructive condition is not limited to the aforementioned examples and may include any type of environmental or artificial condition that causes the structural integrity of the firestat 100 and/or actuator 501 to be compromised in any way.

The foregoing description of various aspects and examples have been presented for purposes of illustration and description. It is not intended to be exhaustive nor to limit the disclosure to the forms described. The embodiment(s) illustrated in the figures can, in some instances, be understood to be shown to scale for illustrative purposes. Numerous modifications are possible in light of the above teachings, including a combination of the above-mentioned aspects. Some of those modifications have been discussed and others will be understood by those skilled in the art. It will be appreciated that various implementations of the above-disclosed and other features and functions, or alternatives or varieties thereof, may be desirably combined into many other different systems or applications. Also that various presently unforeseen or unanticipated alternatives, modifications, variations, or improvements therein may be subsequently made by those skilled in the art which are also intended to be encompassed by the following claims.

The various aspects were chosen and described in order to best illustrate the principles of the present disclosure and various aspects as are suited to the particular use contemplated. The scope of the present disclosure is, of course, not limited to the examples or aspects set forth herein, but can be employed in any number of applications and equivalent devices by those of ordinary skill in the art. Rather, it is hereby intended the scope be defined by the claims appended hereto.

The invention claimed is:

1. A firestat configured to provide an output for controlling an opening and closing of a fire damper, comprising:

a fire damper test switch configured to transition between a closed position and an open position, wherein, in the closed position, the fire damper test switch is configured to create continuity through the fire damper test switch to enable a current to pass therethrough, and wherein, in the open position, the fire damper test switch is configured to create discontinuity through the fire damper test switch to block the current from passing therethrough; and an actuator configured to depress the fire damper test switch to transition the fire damper test switch to the closed position, wherein the actuator is further configured to release the fire damper test switch to transition the fire damper test switch to the open position in response to a depressing force applied to the actuator, and wherein the actuator is configured to deform and release the fire damper test switch in response to an ambient temperature greater than a threshold temperature.

2. The firestat of claim 1, wherein, in the open position, the fire damper test switch is configured to enable the fire damper to close, and wherein, in the closed position, the fire damper test switch is configured to enable the fire damper to open.

3. The firestat of claim 1, wherein the actuator further comprises:

an elongated body extending along a first axis; and a contacting portion that extends along a second axis that is substantially perpendicular to the first axis.

4. The firestat of claim 3, wherein the actuator is configured to be biased in a first direction to depress the fire damper test switch via the contacting portion in a resting state of the actuator, and wherein the contacting portion is configured to disengage the fire damper test switch to transition the fire damper test switch to the open position in response to the depressing force applied to elongated body.

5. The firestat of claim 4, wherein the actuator is configured to move in a second direction that is opposite the first direction in response to the depressing force.

6. The firestat of claim 5, wherein the actuator is configured to be biased in the first direction by an elastic member.

7. The firestat of claim 6, wherein the firestat further comprises a housing, and wherein the elastic member is disposed within the housing and is contained within a cavity of the actuator.

8. The firestat of claim 4, wherein the contacting portion is configured to contact the fire damper test switch, and wherein abutment of the contacting portion against the fire damper test switch limits travel of the actuator in the first direction.

9. The firestat of claim 3, wherein the contacting portion is configured to melt or break in response to the ambient temperature greater than the threshold temperature to release the fire damper test switch such that the fire damper test switch transitions from the closed position to the open position.

10. The firestat of claim 9, wherein the actuator further comprises:

a cavity within the elongated body that extends along the first axis, wherein the cavity is configured to receive a spring.

11. The firestat of claim 10, further comprising:

a protrusion configured to slidably fit within the cavity.

12. The firestat of claim 11, further comprising:

an actuator receiving portion, wherein the actuator receiving portion is configured to slidably receive an outer surface of the elongated body.

13. The firestat of claim 12, comprising a housing, wherein the housing includes the protrusion and the actuator receiving portion, and wherein the fire damper test switch is configured to be mounted within the housing.

14. The firestat of claim 13, wherein the actuator comprises a first end and a second end opposite the first end, the contacting portion is disposed at the first end, the second end is configured to receive the depressing force, and the second end protrudes from an opening in the actuator receiving portion of the housing.

15. The firestat of claim 1, wherein at least a portion of the actuator is configured to melt in response to the ambient temperature greater than the threshold temperature.

16. An apparatus for selectively depressing and releasing a fire damper test switch, comprising:

an actuator configured to depress the fire damper test switch to transition the fire damper test switch to a closed position in a resting state of the actuator to enable a current to pass through the fire damper test switch, wherein the actuator is configured to release the fire damper test switch to transition the fire damper test switch to an open position to block the current from passing through the fire damper test switch in response to a depressing force applied to the actuator, and wherein the actuator comprises:

an elongated body extending along a first axis; and a contacting portion extending from the elongated body along a second axis, wherein the actuator is configured to be biased in a first direction to depress the fire damper test switch via the contacting portion and transition the fire damper test switch to the closed position, and wherein the actuator is movable in a second direction opposite the first direction in response to application of the depressing force to disengage the contacting portion from the fire damper test switch and transition the fire damper test switch to the open position.

17. The apparatus of claim 16, wherein the actuator is configured to be biased in the first direction by an elastic member.

18. The apparatus of claim 17, wherein the actuator is configured to release the fire damper test switch to transition the fire damper test switch to the open position in response to a temperature that causes melting or breakage of the contacting portion.

19. The apparatus of claim 16, wherein the actuator further comprises:

a cavity within the elongated body, wherein the cavity extends along the first axis and is configured to receive a spring.

20. The apparatus of claim 19, wherein the cavity of the actuator is configured to slideably receive a protrusion of a firestat housing.

21. The apparatus of claim 20, wherein the actuator further comprises an outer surface configured to be slidably received by an actuator receiving portion of the firestat housing.

22. The apparatus of claim 20, wherein the protrusion is configured to extend into the cavity and abut the spring to retain the spring within the cavity and bias the actuator in the first direction.

23. A system, comprising:

a fire damper comprising one or more blades configured to transition between an open configuration and a closed configuration; and a firestat configured to control transition of the one or more blades between the open configuration and the closed configuration, wherein the firestat comprises:

a fire damper test switch configured to transition between a closed position and an open position, wherein the fire damper test switch is configured to enable a current to pass therethrough in the closed position, the fire damper test switch is configured to block the current from passing therethrough in the open position, and the one or more blades are configured to transition from the open configuration to the closed configuration in response to transition of the fire damper test switch from the closed position to the open position; and an actuator configured to depress the fire damper test switch to transition the fire damper test switch to the closed position, wherein the actuator is configured to release the fire damper test switch to transition the fire damper test switch to the open position in response to application of a depressing force to the actuator.

24. The system of claim 23, wherein the actuator comprises:

an elongated body extending along a first axis; and a contacting portion extending from the elongated body along a second axis crosswise to the first axis.

25. The system of claim 24, wherein the contacting portion is configured to be biased against the fire damper test switch in a first direction in a resting state of the actuator.

26. The system of claim 25, wherein the actuator is movable in a second direction opposite the first direction, wherein the actuator is configured to release the fire damper test switch in response to application of the depressing force to the actuator in the second direction.

* * * * *